US008849142B2

(12) United States Patent
Sugiyama et al.

(10) Patent No.: US 8,849,142 B2
(45) Date of Patent: Sep. 30, 2014

(54) IMAGE FORMING DEVICE

(75) Inventors: Hiroyuki Sugiyama, Kanagawa (JP); Jun Yura, Kanagawa (JP); Tokuya Ohjimi, Kanagawa (JP); Yukiko Iwasaki, Kanagawa (JP); Jun Shiori, Kanagawa (JP); Masaki Sukesako, Kanagawa (JP); Kazuaki Kamihara, Tokyo (JP); Hironobu Takeshita, Kanagawa (JP); Ryota Kidera, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 115 days.

(21) Appl. No.: 13/477,442

(22) Filed: May 22, 2012

(65) Prior Publication Data

US 2012/0315060 A1 Dec. 13, 2012

(30) Foreign Application Priority Data

Jun. 8, 2011 (JP) ..... 2011-128333

(51) Int. Cl.
*G03G 15/20* (2006.01)

(52) U.S. Cl.
CPC ..... *G03G 15/205* (2013.01); *G03G 15/2078* (2013.01); *G03G 15/040274* (2013.01); *G03G 15/2039* (2013.01)
USPC ..... 399/69; 399/181

(58) Field of Classification Search
CPC ..... G03G 15/2039; G03G 15/205; G03G 15/2078; G03G 15/556
USPC ..... 399/69, 181
See application file for complete search history.

(56) References Cited

U.S. PATENT DOCUMENTS

| | | | |
|---|---|---|---|
| 5,708,949 | A | 1/1998 | Kasahara et al. |
| 6,337,957 | B1 | 1/2002 | Tamaki et al. |
| 6,507,718 | B2 | 1/2003 | Ohjimi et al. |
| 6,559,421 | B1 | 5/2003 | Yura et al. |
| 6,631,253 | B2 | 10/2003 | Nakafuji et al. |
| 6,636,718 | B2 | 10/2003 | Yura et al. |
| 6,646,227 | B2 | 11/2003 | Yura et al. |

(Continued)

FOREIGN PATENT DOCUMENTS

| | | | |
|---|---|---|---|
| JP | 3295273 | A | 10/1996 |
| JP | 2006133580 | A | 5/2006 |

(Continued)

OTHER PUBLICATIONS

US 2009/019664 corresponds to JP 2009-181065.

(Continued)

*Primary Examiner* — Benjamin Schmitt
(74) *Attorney, Agent, or Firm* — Harness, Dickey & Pierce, P.L.C.

(57) ABSTRACT

Disclosed is an image forming device including a fixing unit that fixes a first image to be fixed onto a sheet, the first image to be fixed being supported on the sheet, a target fixing temperature varying unit that varies a target fixing temperature during a time period in which a fixing process is performed, and a gradation processing unit that applies a gradation process to first image information. The target fixing temperature varying unit varies the target fixing temperature for the sheet of the recording medium to which the fixing process is applied, depending on presence or absence of a halftone process, and depending on a type of the gradation process to be utilized.

15 Claims, 25 Drawing Sheets

(56) References Cited

U.S. PATENT DOCUMENTS

| | | | |
|---|---|---|---|
| 6,687,474 | B2 | 2/2004 | Yamada et al. |
| 6,795,676 | B2 | 9/2004 | Kikuchi et al. |
| 6,795,678 | B2 | 9/2004 | Yura et al. |
| 6,847,792 | B2 | 1/2005 | Nakafuji et al. |
| 6,856,774 | B2 | 2/2005 | Sampe et al. |
| 6,873,814 | B2 | 3/2005 | Ohjimi et al. |
| 6,897,409 | B2 | 5/2005 | Yura et al. |
| 6,941,088 | B2 | 9/2005 | Atsushi et al. |
| 7,010,255 | B2 | 3/2006 | Yura et al. |
| 7,058,330 | B2 | 6/2006 | Nakafuji et al. |
| 7,107,681 | B2 | 9/2006 | Yura et al. |
| 7,110,696 | B2 | 9/2006 | Murakami et al. |
| 7,139,504 | B2 | 11/2006 | Yanagida et al. |
| 7,212,753 | B2 | 5/2007 | Suzuki et al. |
| 7,218,879 | B2 | 5/2007 | Enoki et al. |
| 7,224,928 | B2 | 5/2007 | Kikuchi et al. |
| 7,251,429 | B2 | 7/2007 | Nakafuji et al. |
| 7,266,324 | B2 | 9/2007 | Yanagida et al. |
| 7,272,354 | B2 | 9/2007 | Murakami et al. |
| 7,292,816 | B2 | 11/2007 | Ojimi et al. |
| 7,313,347 | B2 | 12/2007 | Shintani et al. |
| 7,315,711 | B2 | 1/2008 | Ariizumi et al. |
| 7,333,744 | B2 | 2/2008 | Shimojo et al. |
| 7,346,305 | B2 | 3/2008 | Kikuchi et al. |
| 7,373,101 | B2 | 5/2008 | Hozumi et al. |
| 7,477,856 | B2 | 1/2009 | Yoneda et al. |
| 7,477,862 | B2 | 1/2009 | Takaya et al. |
| 7,539,451 | B2 | 5/2009 | Kawasumi et al. |
| 7,542,712 | B2 | 6/2009 | Tanaka et al. |
| 7,593,652 | B2 | 9/2009 | Takahashi et al. |
| 7,620,336 | B2 | 11/2009 | Yura et al. |
| 7,672,635 | B2 | 3/2010 | Hozumi et al. |
| 7,676,164 | B2 | 3/2010 | Shiori et al. |
| 7,680,429 | B2 | 3/2010 | Takaya et al. |
| 7,693,471 | B2 | 4/2010 | Kikuchi et al. |
| 7,734,200 | B2 | 6/2010 | Sugiyama et al. |
| 7,826,786 | B2 | 11/2010 | Suda et al. |
| 7,941,075 | B2 | 5/2011 | Shiraishi et al. |
| 8,000,627 | B2 | 8/2011 | Mizuishi et al. |
| 8,010,005 | B2 | 8/2011 | Sukesako et al. |
| 8,080,096 | B2 | 12/2011 | Yamashita et al. |
| 2002/0031382 | A1 | 3/2002 | Yura et al. |
| 2002/0051649 | A1 | 5/2002 | Ohjimi et al. |
| 2002/0076243 | A1 | 6/2002 | Nakafuji et al. |
| 2002/0113050 | A1 | 8/2002 | Yura et al. |
| 2003/0002884 | A1 | 1/2003 | Yamada et al. |
| 2003/0009479 | A1 | 1/2003 | Phair |
| 2003/0016971 | A1 | 1/2003 | Kikuchi et al. |
| 2003/0099481 | A1 | 5/2003 | Sampe et al. |
| 2003/0103788 | A1 | 6/2003 | Yura et al. |
| 2003/0108362 | A1 | 6/2003 | Ohjimi et al. |
| 2003/0192869 | A1 | 10/2003 | Yura et al. |
| 2004/0022552 | A1 | 2/2004 | Yura et al. |
| 2004/0086293 | A1 | 5/2004 | Atsushi et al. |
| 2004/0111888 | A1 | 6/2004 | Yura et al. |
| 2004/0136763 | A1 | 7/2004 | Murakami et al. |
| 2004/0213597 | A1 | 10/2004 | Yanagida et al. |
| 2004/0265017 | A1 | 12/2004 | Kikuchi et al. |
| 2005/0111871 | A1 | 5/2005 | Nakafuji et al. |
| 2005/0141917 | A1 | 6/2005 | Enoki et al. |
| 2005/0152707 | A1 | 7/2005 | Suzuki et al. |
| 2005/0191081 | A1 | 9/2005 | Muraishi et al. |
| 2005/0191574 | A1 | 9/2005 | Koike et al. |
| 2005/0232665 | A1 | 10/2005 | Toshio et al. |
| 2005/0232666 | A1 | 10/2005 | Ojimi et al. |
| 2005/0254846 | A1 | 11/2005 | Yura et al. |
| 2005/0271420 | A1 | 12/2005 | Arai et al. |
| 2005/0276632 | A1 | 12/2005 | Ariizumi et al. |
| 2006/0039726 | A1 | 2/2006 | Shintani et al. |
| 2006/0115286 | A1 | 6/2006 | Uchitani et al. |
| 2006/0127144 | A1* | 6/2006 | Watanabe ..... 399/329 |
| 2006/0133834 | A1 | 6/2006 | Yoneda et al. |
| 2006/0133837 | A1 | 6/2006 | Shimojo et al. |
| 2006/0194662 | A1 | 8/2006 | Hozumi et al. |
| 2006/0210298 | A1 | 9/2006 | Nakafuji et al. |
| 2006/0216085 | A1 | 9/2006 | Murakami et al. |
| 2007/0014588 | A1 | 1/2007 | Yanagida et al. |
| 2007/0059067 | A1 | 3/2007 | Tanaka et al. |
| 2007/0071513 | A1 | 3/2007 | Kikuchi et al. |
| 2007/0122164 | A1 | 5/2007 | Shiori et al. |
| 2007/0122166 | A1 | 5/2007 | Takahashi et al. |
| 2007/0122167 | A1 | 5/2007 | Sugiyama et al. |
| 2007/0224528 | A1 | 9/2007 | Yamashita et al. |
| 2008/0013998 | A1 | 1/2008 | Kumagai et al. |
| 2008/0124106 | A1 | 5/2008 | Enoki et al. |
| 2008/0138124 | A1 | 6/2008 | Kikuchi et al. |
| 2008/0175635 | A1 | 7/2008 | Hozumi et al. |
| 2008/0226333 | A1 | 9/2008 | Ono et al. |
| 2009/0053421 | A1 | 2/2009 | Flosbach et al. |
| 2009/0087213 | A1 | 4/2009 | Takaya et al. |
| 2009/0120356 | A1 | 5/2009 | Karasawa et al. |
| 2009/0196638 | A1 | 8/2009 | Sukesako et al. |
| 2009/0196644 | A1 | 8/2009 | Funatsu |
| 2009/0279910 | A1 | 11/2009 | Shiori |
| 2009/0311006 | A1 | 12/2009 | Shiraishi et al. |
| 2010/0021195 | A1 | 1/2010 | Yura et al. |
| 2010/0040393 | A1 | 2/2010 | Kawahara et al. |
| 2010/0046994 | A1 | 2/2010 | Kikuchi et al. |
| 2010/0098446 | A1 | 4/2010 | Ishikawa et al. |
| 2010/0278558 | A1 | 11/2010 | Enoki et al. |
| 2011/0026958 | A1 | 2/2011 | Shiori |
| 2011/0211854 | A1 | 9/2011 | Shiori et al. |
| 2011/0217061 | A1* | 9/2011 | Ichikawa et al. ..... 399/69 |
| 2011/0229232 | A1 | 9/2011 | Kojima et al. |
| 2011/0262179 | A1 | 10/2011 | Mizuishi et al. |
| 2012/0009878 | A1 | 1/2012 | Buck et al. |
| 2012/0045235 | A1 | 2/2012 | Shiori et al. |
| 2012/0069358 | A1* | 3/2012 | Nakajima ..... 358/1.9 |
| 2012/0093528 | A1 | 4/2012 | Shiori et al. |
| 2012/0114358 | A1 | 5/2012 | Sugiyama et al. |
| 2012/0114359 | A1 | 5/2012 | Yura et al. |
| 2012/0177406 | A1 | 7/2012 | Suzuki et al. |
| 2012/0213540 | A1* | 8/2012 | Igarashi ..... 399/69 |
| 2012/0230711 | A1 | 9/2012 | Shiori et al. |

FOREIGN PATENT DOCUMENTS

| | | | | |
|---|---|---|---|---|
| JP | 2006133580 | A * | 5/2006 | ..... G03G 21/00 |
| JP | 2008185638 | A | 8/2008 | |
| JP | 2008268784 | A | 11/2008 | |
| JP | 2009053421 | A | 3/2009 | |
| JP | 2009181065 | A | 8/2009 | |

OTHER PUBLICATIONS

JP 08-278725 corresponds to JP 3295273.
U.S. Appl. No. 13/347,208.
U.S. Appl. No. 13/411,956.

* cited by examiner

FIG.4

| | IMAGE FORMING MODE | PHOTO AREA | TEXT AREA |
|---|---|---|---|
| PRINT | GENERAL DOCUMENT (SPEED PRIORITIZED) | CONCENTRATED 150[lpi] | CONCENTRATED 200[lpi] |
| | GENERAL DOCUMENT (IMAGE QUALITY PRIORITIZED) | LINE 150[lpi] | DIFFUSION 300[lpi] |
| | PHOTO (IMAGE QUALITY PRIORITIZED) | LINE 200[lpi] | DIFFUSION 300[lpi] |
| | HIGH-RESOLUTION | LINE 250[lpi] | DIFFUSION 600[lpi] |
| COPY | | ERROR DIFFUSION | |

FIG.6

| NUMBER OF LINES [lpi] | TYPE OF DITHER METHOD | | |
|---|---|---|---|
| | CONCENTRATED | LINE | DIFFUSION |
| 150 | LEVEL 1 TEMPERATURE | LEVEL 1 TEMPERATURE | LEVEL 1 TEMPERATURE |
| 200 | LEVEL 1 TEMPERATURE | LEVEL 1 TEMPERATURE | NORMAL TEMPERATURE |
| 250 | NORMAL TEMPERATURE | NORMAL TEMPERATURE | NORMAL TEMPERATURE |
| 300 | NORMAL TEMPERATURE | NORMAL TEMPERATURE | NORMAL TEMPERATURE |

FIG.7

| IMAGE FORMING MODE | PHOTO AREA | | TEXT AREA | |
|---|---|---|---|---|
| | LESS THAN 100% IMAGE EXISTS | 100% IMAGE ONLY | LESS THAN 100% IMAGE EXISTS | 100% IMAGE ONLY |
| GENERAL DOCUMENT (SPEED PRIORITIZED) | LEVEL 1 TEMPERATURE | LEVEL 2 TEMPERATURE | LEVEL 1 TEMPERATURE | LEVEL 2 TEMPERATURE |
| GENERAL DOCUMENT (IMAGE QUALITY PRIORITIZED) | LEVEL 1 TEMPERATURE | LEVEL 2 TEMPERATURE | NORMAL TEMPERATURE | LEVEL 2 TEMPERATURE |
| PHOTO (IMAGE QUALITY PRIORITIZED) | LEVEL 1 TEMPERATURE | LEVEL 2 TEMPERATURE | NORMAL TEMPERATURE | LEVEL 2 TEMPERATURE |
| HIGH-RESOLUTION | NORMAL TEMPERATURE | NORMAL TEMPERATURE | NORMAL TEMPERATURE | NORMAL TEMPERATURE |

FIG.13

[FULL-COLOR PRINTING]

| IMAGE FORMING MODE | PHOTO AREA | | TEXT AREA | |
|---|---|---|---|---|
| | LESS THAN 100% IMAGE EXISTS | 100% IMAGE ONLY | LESS THAN 100% IMAGE EXISTS | 100% IMAGE ONLY |
| GENERAL DOCUMENT (SPEED PRIORITIZED) | NORMAL TEMPERATURE | NORMAL TEMPERATURE | NORMAL TEMPERATURE | NORMAL TEMPERATURE |
| GENERAL DOCUMENT (IMAGE QUALITY PRIORITIZED) | NORMAL TEMPERATURE | NORMAL TEMPERATURE | NORMAL TEMPERATURE | NORMAL TEMPERATURE |
| PHOTO (IMAGE QUALITY PRIORITIZED) | NORMAL TEMPERATURE | NORMAL TEMPERATURE | NORMAL TEMPERATURE | NORMAL TEMPERATURE |
| HIGH-RESOLUTION | NORMAL TEMPERATURE | NORMAL TEMPERATURE | NORMAL TEMPERATURE | NORMAL TEMPERATURE |

[MONOCHROME PRINTING]

| IMAGE FORMING MODE | PHOTO AREA | | TEXT AREA | |
|---|---|---|---|---|
| | LESS THAN 100% IMAGE EXISTS | 100% IMAGE ONLY | LESS THAN 100% IMAGE EXISTS | 100% IMAGE ONLY |
| GENERAL DOCUMENT (SPEED PRIORITIZED) | LEVEL 2 TEMPERATURE | LEVEL 3 TEMPERATURE | LEVEL 2 TEMPERATURE | LEVEL 3 TEMPERATURE |
| GENERAL DOCUMENT (IMAGE QUALITY PRIORITIZED) | LEVEL 2 TEMPERATURE | LEVEL 3 TEMPERATURE | LEVEL 1 TEMPERATURE | LEVEL 3 TEMPERATURE |
| PHOTO (IMAGE QUALITY PRIORITIZED) | LEVEL 2 TEMPERATURE | LEVEL 3 TEMPERATURE | LEVEL 1 TEMPERATURE | LEVEL 3 TEMPERATURE |
| HIGH-RESOLUTION | LEVEL 1 TEMPERATURE | LEVEL 1 TEMPERATURE | LEVEL 1 TEMPERATURE | LEVEL 1 TEMPERATURE |

FIG.18

| IMAGE FORMING MODE | PHOTO AREA | | TEXT AREA | |
|---|---|---|---|---|
| | LESS THAN 100% IMAGE EXISTS | 100% IMAGE ONLY | LESS THAN 100% IMAGE EXISTS | 100% IMAGE ONLY |
| GENERAL DOCUMENT (SPEED PRIORITIZED) | LEVEL 1 TEMPERATURE | LEVEL 2 TEMPERATURE | LEVEL 1 TEMPERATURE | LEVEL 2 TEMPERATURE |
| GENERAL DOCUMENT (IMAGE QUALITY PRIORITIZED) | LEVEL 1 TEMPERATURE | LEVEL 2 TEMPERATURE | LEVEL 1 TEMPERATURE | LEVEL 2 TEMPERATURE |
| PHOTO (IMAGE QUALITY PRIORITIZED) | LEVEL 1 TEMPERATURE | LEVEL 2 TEMPERATURE | LEVEL 1 TEMPERATURE | LEVEL 2 TEMPERATURE |
| HIGH-RESOLUTION | NORMAL TEMPERATURE | NORMAL TEMPERATURE | NORMAL TEMPERATURE | NORMAL TEMPERATURE |

FIG.19

| IMAGE FORMING MODE | PHOTO AREA | | TEXT AREA | |
|---|---|---|---|---|
| | LESS THAN 100% IMAGE EXISTS | 100% IMAGE ONLY | LESS THAN 100% IMAGE EXISTS | 100% IMAGE ONLY |
| GENERAL DOCUMENT (SPEED PRIORITIZED) | LEVEL 1 TEMPERATURE | LEVEL 2 TEMPERATURE | LEVEL 1 TEMPERATURE | LEVEL 2 TEMPERATURE |
| GENERAL DOCUMENT (IMAGE QUALITY PRIORITIZED) | LEVEL 1 TEMPERATURE | LEVEL 2 TEMPERATURE | NORMAL TEMPERATURE | LEVEL 2 TEMPERATURE |
| PHOTO (IMAGE QUALITY PRIORITIZED) | LEVEL 1 TEMPERATURE | LEVEL 2 TEMPERATURE | NORMAL TEMPERATURE | LEVEL 2 TEMPERATURE |
| HIGH-RESOLUTION | LEVEL 1 TEMPERATURE | LEVEL 2 TEMPERATURE | NORMAL TEMPERATURE | LEVEL 2 TEMPERATURE |

FIG.20

| IMAGE FORMING MODE | PHOTO AREA | | TEXT AREA | |
|---|---|---|---|---|
| | LESS THAN 100% IMAGE EXISTS | 100% IMAGE ONLY | LESS THAN 100% IMAGE EXISTS | 100% IMAGE ONLY |
| GENERAL DOCUMENT (SPEED PRIORITIZED) | LEVEL 1 TEMPERATURE | LEVEL 2 TEMPERATURE | LEVEL 1 TEMPERATURE | LEVEL 2 TEMPERATURE |
| GENERAL DOCUMENT (IMAGE QUALITY PRIORITIZED) | LEVEL 1 TEMPERATURE | LEVEL 2 TEMPERATURE | LEVEL 1 TEMPERATURE | LEVEL 2 TEMPERATURE |
| PHOTO (IMAGE QUALITY PRIORITIZED) | LEVEL 1 TEMPERATURE | LEVEL 2 TEMPERATURE | LEVEL 1 TEMPERATURE | LEVEL 2 TEMPERATURE |
| HIGH-RESOLUTION | LEVEL 1 TEMPERATURE | LEVEL 2 TEMPERATURE | LEVEL 1 TEMPERATURE | LEVEL 2 TEMPERATURE |

IMAGE FORMING DEVICE

BACKGROUND OF THE INVENTION

1. Field of the Invention

Embodiments of the present invention relate to an image forming device, such as a copier, a printer, a facsimile machine, and a combined machine thereof.

2. Description of the Related Art

An electrophotographic image forming device, such as a copier, a printer, a facsimile machine, or a combined machine thereof includes a fixing device for fusing and fixing toner (developer) adhered to a sheet of paper. For the fixing device, a temperature required for fixing a toner image (a fixing temperature), which is not fixed onto the sheet of paper, has been set in advance. However, the required temperature varies depending on a type of the toner image or a type of the sheet of paper.

As a factor that causes the fixing temperature to vary, for example, density of toner adhered to the sheet of paper, and an amount of isolated toner dots adhered to the sheet of paper can be considered. When a coverage rate is high and the amount of the isolated toner dots is large, a higher fixing temperature may be required, compared to a case in which the coverage rate is low and the amount of the isolated toner dots is small. Therefore, for a conventional image forming device, a target fixing temperature is set based on the worst condition for fixing the toner image.

However, if the condition for fixing, which is equivalent to the fixing condition for the case in which it is difficult to fix the toner image, is applied in a case in which it is easy to fix a toner image, the fixing temperature is maintained at an unnecessarily high temperature. Thus, the power is unnecessarily consumed in a heating device, contradicting the requirement of reducing the energy consumption in recent years.

Therefore, techniques have been proposed as described below. Namely, the techniques are for suitably switching the condition for fixing, between a case in which a toner image is easily fixed and a case in which a toner image is not easily fixed. For example, Patent Document 1 (Japanese Published Unexamined Application No. 2009-53421) discloses a technique for optimizing an amount of heat for fixing a toner image by adjusting a nip width depending on an amount of toner used for an image to be fixed.

Further, Patent Document 2 (Japanese Published Unexamined Application No. 2006-133580) discloses a technique for raising the fixing temperature for a low toner consumption mode (a mode for reducing toner consumption) for performing area coverage modulation processing, in which a unit that analyzes data on a pixel-by-pixel basis and applies dithering to, for example, a black image that includes many pixels and a unit that generates a halftone image by controlling a time period for emitting laser light on a dot-by-dot basis are utilized.

Further, Patent Document 3 (Japanese Registered Patent No. 3295273) discloses a technique for switching a start-up time for fixing between a text mode and a photo mode. Further, Patent Document 4 (Japanese Published Unexamined Application No. 2008-185638) discloses a technique for controlling the fixing temperature by determining whether colored fine pixels are isolatedly arranged. Further, Patent Document 5 (Japanese Published Unexamined Application No. 2008-268784) discloses a technique that raises an optimum fixing temperature for a portion in which a coverage rate is high, such as a photograph, compared to that of a portion in which a coverage rate is low, such as text. Additionally, Patent Document 5 discloses that coverage rates are calculated for a photo area and a text area, respectively, and that the fixing temperatures are individually optimized for the photo area and the text area. Further, Patent Document 6 (Japanese Published Unexamined Application No. 2009-181065) discloses a technique for controlling the fixing temperature depending on image density information based on a data dot number per a predetermined area, so as to optimize the fixing temperature depending on image information.

The above patent documents disclose configurations that can optimize the temperature, for a case in which one sheet of recording medium is fed through a device, or for a case in which sheets of recording media are fed through a device in a constant fixing mode (e.g., the photo mode, or the text mode). However, for these configurations, a case is not considered, in which the fixing temperature is varied on a sheet-by-sheet basis while sheets of recording media are continuously fed. Thus, these configurations are not suitable for performing temperature control on a sheet-by-sheet basis during continuous feeding of the sheets of recording media.

Specifically, in Patent Document 1, it is described that the amount of heat for fixing is optimized by adjusting the nip width depending on the amount of the toner included in the image to be fixed. However, it is quite difficult to adjust the nip width for fixing on a sheet-by-sheet basis during continuous feeding of the sheets of recording media. Since the processing speeds of recent image forming devices are increasing, it is not realistic to perform this control on a sheet-by-sheet basis during continuous feeding.

Further, the techniques disclosed in Patent Documents 2 and 3 are for controlling the fixing temperature depending on the selected mode. Thus, for these configurations, it is not considered to control the fixing temperature on a sheet-by-sheet basis during continuous feeding of the sheets of recording media.

Patent Document 4 discloses the technique for controlling the fixing temperature by determining whether the colored fine pixels are isolatedly arranged. In the technique, when an image is divided into pixels having small areas, and the pixels having small areas are further divided into fine pixels, the fixing control is varied depending on colored areas of the fine pixels. Hence, when the temperature control is performed on a sheet-by-sheet basis during continuous feeding, an amount of information per one sheet becomes huge. Therefore, it becomes difficult to determine to what extent the fixing temperature can be decreased. Even if the control is possible, the load on the information processing is huge.

Further, Patent Document 5 merely discloses the technique for controlling the fixing temperature depending on the area of the image, when an output image, in which photo images and text images are mixed, is fixed. Patent Document 5 does not propose a technique for performing temperature control on a sheet-by-sheet basis during continuous feeding.

Further, Patent Document 6 discloses the technique for controlling the fixing temperature depending on the image density information, which is based on the data dot number per the predetermined area, so as to optimize the fixing temperature depending on the image data. However, in this case, similar to the case of Patent Document 4, an amount of information per one sheet becomes huge, and it is difficult to determine to what extent the fixing temperature can be decreased. Even if the control is possible, the load on the information processing is huge.

SUMMARY OF THE INVENTION

The embodiments of the present invention have been developed in view of the above-described circumstances. An objective of the embodiments is to provide an image forming device that can optimize a fixing temperature on a sheet-by-sheet basis during continuous printing, without processing a huge amount of information and without selecting a specific mode.

In one aspect, there is provided an image forming device including a fixing unit configured to fix a first image to be fixed onto a sheet of a recording medium, the first image to be fixed being supported on the sheet of the recording medium; a target fixing temperature varying unit configured to vary a target fixing temperature during a time period in which a fixing process is performed; and a gradation processing unit configured to apply a gradation process to first image information. The target fixing temperature varying unit is configured to vary the target fixing temperature for each sheet of the recording medium to which the fixing process is applied, depending on presence or absence of a halftone process, and depending on a type of the gradation process to be utilized.

Since a fixing property of an image depends on the presence or absence of the halftone process and the type of the gradation process utilized, when the fixing property of the image is advantageous, the target fixing temperature can be set to be a lower temperature by changing the target fixing temperature based on the information about the presence or absence of the halftone process and the type of the gradation process. In this manner, energy consumption can be reduced while maintaining the fine fixing property. Further, in this case, a huge amount of information is not required and a target fixing temperature can be set to an optimized temperature on a sheet-by-sheet basis, only by obtaining information about presence or absence of the halftone process and the type of the gradation processing utilized, without selecting a specific mode.

The gradation processing unit may perform plural types of gradation processes, and the gradation processing unit may be able to apply a dither method as a first one of the plural types of the gradation processes. Here, when the type of the gradation process to be utilized is the dither method, the target fixing temperature varying unit may vary the target fixing temperature, depending on a type of the dither method, and depending on a first line density.

Since the fixing property of the image varies depending on the type of the dither method and the number of the lines per inch, the energy consumption can further be reduced while maintaining the fine fixing property, by varying the target fixing temperature based on the type of the dither method and the number of the lines per inch.

The image forming device may perform a copy output process for outputting second image information, the second image information being read from an original document, and perform a printer output process for outputting third image information, the third image information being received from an external device. Here, when the image forming device performs the copy output process, the gradation processing unit may apply an error diffusion method, as a second one of the plural types of the gradation processes. Further, when the image forming device performs the printer output process, the gradation processing unit may apply the dither method.

In the image forming device having such a configuration, the energy consumption can be reduced while maintaining the fine fixing property by setting the target fixing temperature based on the type of the dither method and the number of the lines per inch.

When the gradation processing unit applies the dither method as the first one of the plural types of the gradation processes, the target fixing temperature varying unit may set the target fixing temperature to a first temperature. Further, when the gradation processing unit applies the error diffusion method as the second one of the plural types of the gradation process, the target fixing temperature varying unit may set the target fixing temperature to a second temperature. Here, the first temperature is lower than the second temperature.

When the error diffusion method is utilized as the gradation process, since many toner particles on the recording medium form isolated small dots, it is possible that the toner dots are removed after printing, if the toner dots are not fixed at a sufficiently high temperature. On the other hand, when the dither method is utilized, the amount of the toner forming the isolated dots is small compared to that of the error diffusion method. Therefore, when the dither method is utilized as the gradation process, the target fixing temperature can be lowered, compared to a case in which the error diffusion method is utilized as the gradation process.

Operation modes of the image forming device may include plural image forming modes for changing at least one of resolution of a fixed image and a level of a size of an image dot diameter. Here, the gradation processing unit may change the type of the dither method and the first number of the lines per inch, based on a specific image forming mode selected among the plural image forming modes.

In the image forming device having such a configuration, the energy consumption can be reduced while maintaining the fine fixing property, by setting the target fixing temperature based on the type of the dither method and the number of the lines per inch.

The image forming device may include an area detection unit configured to detect, for each sheet of the recording media, text areas and photo areas in a second image. Here, the gradation processing unit may change the type of the dither method and the first number of the lines per inch, based on a detection result of the area detection unit.

In the image forming device having such a configuration, the energy consumption can be reduced while maintaining the fine fixing property, by setting the target fixing temperature based on the type of the dither method and the number of the lines per inch.

The gradation processing unit may change at least one of a predefined type of the dither method and a predefined line density corresponding to at least one of a second type of the dither method and a second line density. Here, the predefined type of the dither method and the predefined line density are to be utilized for forming a predetermined image, and the second type of the dither method and the second line density are more advantageous for fixing the predetermined image than the predefined type of the dither method and the predefined line density.

The target fixing temperature may be set to a lower temperature by changing at least one of the type of the dither method and the number of the lines per inch, which are set in advance, to an alternative, which is advantageous in the fixing property. In this manner, the energy consumption is further reduced.

The image forming device may shift a timing to start varying the target fixing temperature from a first temperature for a first sheet of the recording medium to a second temperature for a second sheet of the recording medium, depending on a temperature difference between the first temperature and the second temperature. Here, the first sheet of the recording medium and the second sheet of the recording medium are included in plural sheets of the recording media to which the fixing process is continuously applied. The fixing process is applied to the second sheet of the recording medium, immediately after the fixing process has been applied to the first sheet.

By making the timing to start changing the target fixing temperature to be variable depending on a temperature difference between before and after the change of the target fixing temperature, the fixing temperature can be controlled to be a desired temperature for each sheet of recording media during continuous processing, even if the number of the sheets processed per unit time during the continuous processing is large. In this manner, a failure, such as a cold offset caused by the fixing temperature, which is not increased in accordance with the target fixing temperature, may be prevented from occurring. Further, since it is not necessary to provide a time period for waiting until the fixing temperature is sufficiently increased, the fixing temperature can be switched without lowering productivity (printing speed).

When the second temperature is higher than the first temperature, the timing to start varying the target fixing temperature may be earlier, as the temperature difference becomes greater.

When the target fixing temperature for the second recording medium, to which the fixing process is to be subsequently applied, is higher than the target fixing temperature of the first recording medium, the fixing temperature may be made to reach the target fixing temperature in time, by starting the change of the target fixing temperature at an earlier timing, as the difference between the target fixing temperatures becomes greater.

The timing to start varying the target fixing temperature may be earlier for a first case in which the second temperature is higher than the first temperature, compared to the timing to start varying the target fixing temperature for a second case in which the second temperature is lower than the first temperature.

When the target fixing temperature for the second recording medium, to which the fixing process is to be subsequently applied, is higher than the target fixing temperature for the first recording medium, a failure, such as the cold offset, may be prevented from occurring, by starting the change of the target fixing temperature at an earlier timing, compared to a case in which the target fixing temperature for the second recording medium, to which the fixing process is subsequently applied, is lower than the fixing temperature for the first recording medium, to which the fixing process has been performed immediately before.

The image forming device may include plural image forming units. When the second temperature is higher than the first temperature, the timing to start varying the target fixing temperature may be substantially equal to a timing at which an earliest image forming unit among the plural image forming units starts an image forming operation on the first recording medium.

When the target fixing temperature for the second recording medium, to which the fixing process is subsequently applied, is higher than the target fixing temperature for the (first) recording medium, to which the fixing process has been applied immediately before, by starting the change of the target fixing temperature at the timing at which the first image forming unit starts image forming operations, the change of the target fixing temperature can be started at an earlier timing, and a failure, such as the cold offset, can be prevented from occurring.

When the second temperature is lower than the first temperature, the timing to start varying the target fixing temperature may be substantially equal to a timing at which the first sheet of the recording media completes passing through the fixing unit.

When the target fixing temperature for the second recording medium, to which the fixing process is subsequently applied, is lower than the target fixing temperature for the first recording medium, the change of the target fixing temperature can be started immediately after the (first) recording medium, to which the fixing process has been applied immediately before, passes through the fixing device. In such a case, a failure does not occur, even if the fixing temperature is not completely lowered to the target fixing temperature.

The fixing unit may include a fixing member configured to fix the first image to be fixed onto the sheet of the recording medium; a pressing member configured to form a fixing nip by pressing the fixing member; and an induction heating unit configured to induction-heat the fixing member.

The configuration according to any of the embodiments can be applied to the image forming device having such a configuration.

Alternatively, the fixing unit may include a fixing belt having an endless shape and configured to fix the first image to be fixed onto the sheet of the recording medium; a supporting member configured to support an inner circumferential surface of the fixing belt; a heating member configured to heat the fixing belt; a pressing member configured to press the fixing belt from an outer circumferential side; and a nip forming member disposed at an inner circumferential side and configured to form a fixing nip by contacting the pressing member through the fixing belt.

The configuration according to any of the embodiments can be applied to the image forming device having such a configuration.

Alternatively, the fixing device may include a fixing member configured to fix the first image to be fixed onto the sheet of the recording medium; a pressing member configured to form a fixing nip by pressing the fixing member; and a heating member configured to heat at least one of the fixing member and the pressing member. Here, the heating member is formed by arranging a resistance heating unit inside a flexible film-like member.

The configuration according to any of the embodiments can be applied to the image forming device having such a configuration.

In the image forming device, a temperature required for fixing a black toner may be 10 degrees Celsius or more lower than a temperature required for fixing a color toner. Here, the black toner includes, at least, a thermoplastic resin. The thermoplastic resin includes, at least, a crystalline polyester resin, a non-crystalline polyester resin, a wax, and a colorant.

The configuration according to any of the embodiments may be applied to the image forming device which has the above configuration.

According to the embodiments, it suffices to obtain the information about presence or absence of the halftone process and the information about the type of the gradation processing utilized, as the information to be obtained for controlling the target fixing temperature. Hence, a huge amount of information is not required and an optimized target fixing temperature (during fixing) can be set on a sheet-by-sheet basis during continuous printing, without selecting a specific mode. With this, an image forming device can be provided, which satisfies the requirement on reduction of the energy consumption in recent years, and the requirement on reduction of the starting time.

Other objects, features and advantages of the present invention will become more apparent from the following detailed description when read in conjunction with the accompanying drawings.

BRIEF DESCRIPTION OF THE DRAWINGS

FIG. 4 is a diagram showing specific examples of types of dither methods and numbers of lines per inch for a photo area and a text area for each image forming mode;

FIG. 6 is a diagram showing target fixing temperatures to be selected depending on the type of dither method and the number of the lines per inch, when the dither method is utilized as a gradation processing method;

FIG. 7 is a diagram indicating the target fixing temperatures corresponding to the image forming modes, depending on whether an area is the photo area or the text area, and depending on whether a halftone image exists;

FIG. 13 is a diagram indicating the target fixing temperatures corresponding to the image forming modes in a fifth embodiment, depending on whether an area is the photo area or the text area, and depending on whether a halftone image exists;

FIG. 18 is a diagram showing examples of the target fixing temperatures, which have been set when the type of the dither method is changed in an energy saving mode;

FIG. 19 is a diagram showing examples of the target fixing temperatures, which have been set when the number of lines per inch is changed in the energy saving mode;

FIG. 20 is a diagram showing examples of the target fixing temperatures which have been set when the type of the dither method and the number of lines per inch are changed in the energy saving mode;

DETAILED DESCRIPTION OF THE PREFERRED EMBODIMENTS

Figure 1:
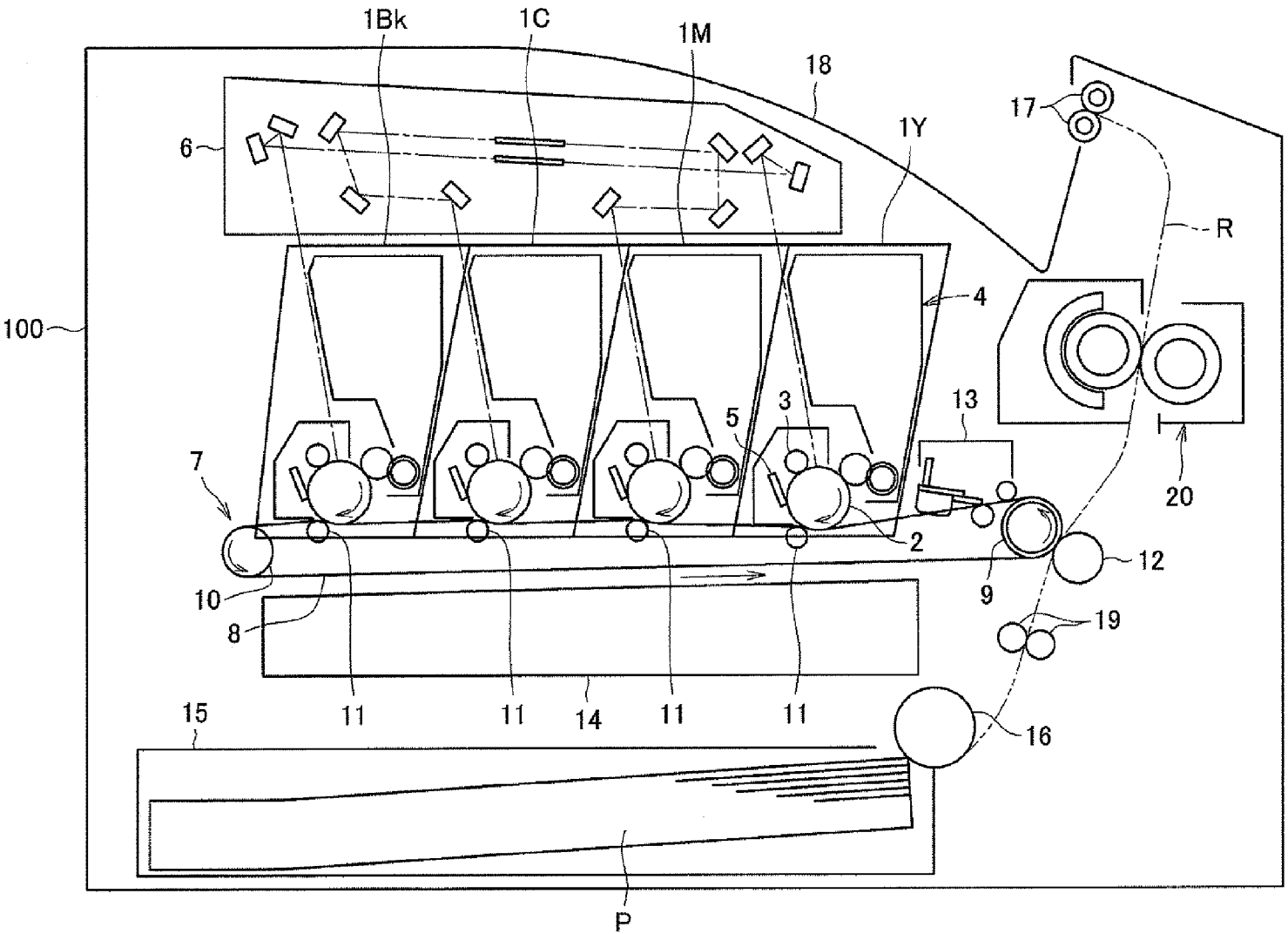
FIG. 1 is a schematic cross-sectional diagram showing a configuration of an image forming device according to an embodiment.

Hereinafter, the embodiments of the present invention are explained based on the accompanying figures. Here, for elements, such as members or components, having the same function or the same shape, the same reference numeral is attached in the figures for illustrating the embodiments, provided that the elements can be identified to have the same functions or the same shapes. Further, after one of the elements is explained, explanations for the other elements are omitted.

First, an overall configuration and operations of an image forming device according to an embodiment is explained. The image forming device shown in FIG. 1 is a color laser printer. Four process units 1Y, 1M, 1C, and 1Bk are detachably attached to a main body 100 of the image forming device, as image forming units. The process units 1Y, 1M, 1C, and 1Bk have the same configuration, except that the process unit 1Y stores yellow (Y) toner, the process unit 1M stores magenta (M) toner, the process unit 1C stores cyan (C) toner, and the process unit 1Bk stores black (Bk) toner. Here, the colors of yellow, magenta, cyan, and black correspond to color separation components of a color image.

Specifically, each of the process units 1Y, 1M, 1C, and 1Bk includes, for example, a photosensitive body 2 having a drum shape as an image supporting body; a charging device including a charging roller 3 for charging the surface of the photosensitive body 2; a developer 4 for supplying toner (developer) to the surface of the photosensitive body 2; and a photosensitive body cleaning blade 5 for cleaning the surface of the photosensitive body 2. In FIG. 1, the reference numerals are attached to the photosensitive body 2, the charging roller 3, the developer 4, and the cleaning blade 5 included in the process unit 1Y for yellow only. The reference numerals are omitted for other process units 1M, 1C, and 1Bk.

In FIG. 1, an exposure device 6 is disposed above the process units 1Y, 1M, 1C, and 1Bk. The exposure device 6 is for exposing the surface of the photosensitive body 2. The exposure device 6 includes a light source, a polygon mirror, a f-theta lens, and a reflecting mirror. The exposure device 6 irradiates laser light onto the surfaces of the photosensitive bodies 2, based on image data.

Further, below the process units 1Y, 1M, 1C, and 1Bk, a transfer device 7 is disposed. The transfer device 7 includes an intermediate transfer belt 8 as a transfer body. The intermediate transfer belt 8 is formed of an endless belt. The intermediate transfer belt 8 is supported by a driving roller 9 and a driven roller 10. As the driving roller rotates counterclockwise in FIG. 1, the intermediate transfer belt 8 circulates (rotates) in a direction indicated by the arrow in FIG. 1.

At four positions facing the four photosensitive bodies 2, four primary transfer rollers 11 are arranged as primary transfer units. Each of the primary transfer rollers 11 presses an inner circumferential surface of the intermediate transfer belt 8 at the corresponding position, so as to form a primary transfer nip at the position where the pressed portion of the intermediate transfer belt 8 contacts the primary transfer roller 11. Each of the primary transfer rollers 11 is connected to a power supply (not shown), and a predetermined direct-current voltage (DC) and/or a predetermined alternative-current voltage (AC) is applied to the primary roller 11.

Further, a secondary transfer roller 12 is arranged at a position facing the driving roller 9 as a secondary transfer unit. The secondary transfer roller 12 is pressing an outer circumferential surface of the intermediate transfer belt 8, so as to form a secondary transfer nip at a position where the secondary transfer roller 12 contacts the intermediate transfer belt 8. Similar to the primary transfer roller 11, the secondary transfer roller 12 is connected to the power supply (not shown), and a predetermined direct-current voltage (DC) and/or a predetermined alternative-current voltage (AC) is applied to the secondary transfer roller 12.

Further, a belt cleaning device 13 for cleaning the surface of the intermediate transfer belt 8 is disposed on the outer circumferential surface in a right end side of the intermediate transfer belt 8 in FIG. 1. A waste toner conveyance hose (not shown) extending from the belt cleaning device 13 is connected to an entrance portion of a waste toner storage 14, which is disposed below the transfer device 7.

Below the main body 100, a paper feed cassette 15 that stores sheets of recording media P, such as paper or transparencies, is disposed. The paper feed cassette 15 includes a paper feed roller 16 for sending out the stored sheets of the recording media P. On the other hand, in an upper portion of the main body 100, a pair of paper ejection rollers 17 for ejecting the sheets of recording media P to the outside, and a paper ejection tray 18 for stacking and storing the ejected sheets of the recording media P are arranged.

In the main body 100, a conveyance path R for conveying the sheets of recording media P from the paper feed cassette 15 to the paper ejection tray 18 through the secondary transfer nip is provided. In the conveyance path R, a pair of registration rollers 19 is arranged at a position upstream in a sheet conveyance direction of the position of the secondary transfer roller 12. Further, a fixing device 20 is arranged at a position downstream in the sheet conveyance direction of the position of the secondary transfer roller 12.

Hereinafter, a basic operation of the image forming device is explained by referring to FIG. 1. When an image forming operation is started, the photosensitive bodies of the process units 1Y, 1M, 1C, and 1Bk, respectively, are rotationally driven in the clockwise direction, and the surfaces of the photosensitive bodies 2 are uniformly charged in a predetermined polarity by the corresponding charging rollers 3. Based on image information of an original document read by a scanning device (not shown), laser beams are irradiated from the exposure device 6 onto the charged surfaces of the photosensitive bodies 2, and electrostatic latent images are formed on the surfaces of the corresponding photosensitive bodies 2. Here, the image information exposed to the corresponding photosensitive body 2 is single color image information corresponding to one of a yellow image, a magenta image, a cyan image, and a black image, which are obtained by color-decomposing a desired full color image. In this manner, when the toner is supplied to the electrostatic latent images formed on the corresponding photosensitive bodies 2, the electrostatic latent images are developed (visualized) as toner images.

The driving roller 9 supporting the intermediate transfer belt 8 is rotationally driven, and the intermediate transfer belt 8 is circulated in the direction of the arrow in FIG. 1. Further, a transfer electric field is formed at the corresponding primary transfer nip between the corresponding primary transfer roller 11 and the corresponding photosensitive body 12, when a voltage is applied to the corresponding primary transfer roller 11. Here, the voltage applied to the corresponding primary transfer roller 11 has the opposite polarity to the charging polarity of the toner, and is controlled to be a constant voltage or to be a constant current. Subsequently, the toner images in the corresponding colors on the corresponding photosensitive bodies 2 are sequentially superposed and transferred onto the intermediate transfer belt 8 by the corresponding transfer electric fields formed at the corresponding primary transfer nips. In this manner, a full color toner image is supported on the surface of the intermediate transfer belt 8. Further, the toner on the corresponding photosensitive body 2, which has not been transferred onto the intermediate transfer belt 8, is removed by the corresponding cleaning blade 5.

Further, when an image forming operation is started, the paper feed roller 16 rotates and the sheets of the recording media P are fed from the paper feed cassette 15 on a sheet-by-sheet basis. The sheet of the recording medium P is conveyed to the secondary transfer nip between the secondary transfer roller 12 and the intermediate transfer belt 8 at an appropriate timing, which is regulated by the registration rollers 19. At this time, a transfer voltage, whose polarity is opposite to the charging polarity of the toner forming the superposed toner images on the intermediate transfer belt 8, is applied to the secondary transfer roller 12. In this manner, a transfer electric field is formed at the secondary transfer nip. Then, the superposed toner images on the intermediate transfer belt 8 are transferred onto the sheet of the recording medium P all together, by the transfer electric field formed at the secondary transfer nip. After that, the sheet of recording paper P is fed to the fixing device 20, and the toner images are fixed onto the sheet of recording medium P. Then, the sheet of recording paper P is ejected onto the paper ejection tray 18 by the pair of the ejection rollers 17.

The above explanation is the image forming operation for the case of forming the full color image on the sheet of recording medium P. However, a monochrome image may be formed by using one of the four process units 1Y, 1M, 1C, and 1Bk, and a two-color image or a three color image may be formed by using two or three of the four process units 1Y, 1M, 1C, and 1Bk.

Figure 2:
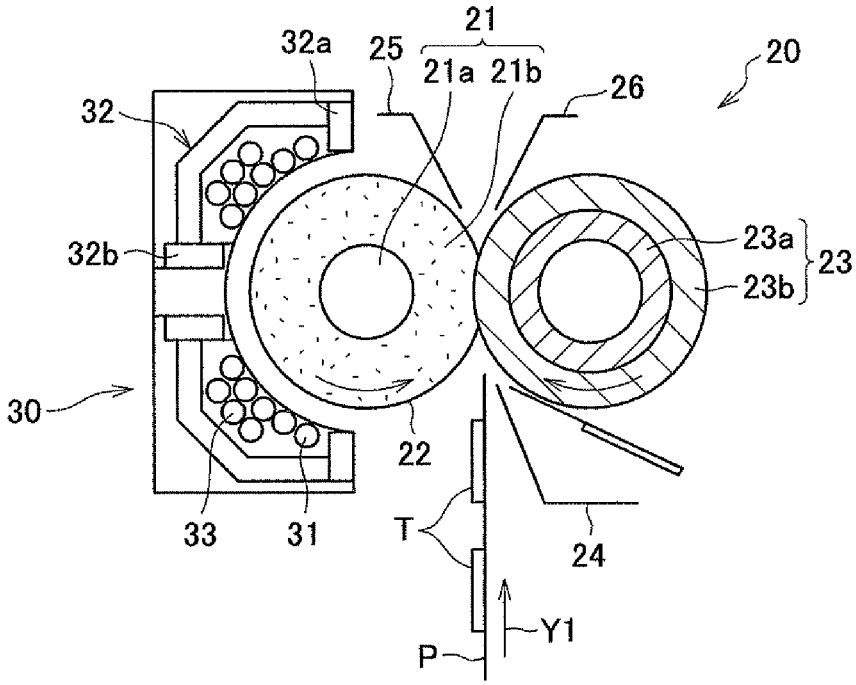
FIG. 2 is a schematic cross-sectional diagram showing a configuration of a fixing device mounted on the image forming device.

Next, a configuration and an operation of the fixing device 20 are explained by referring to FIG. 2. The fixing device 20 includes, for example, a fixing sleeve 22 as a fixing member for fixing an image T to be fixed onto the sheet of recording medium P, a fixing roller 21 as a supporting member for supporting the fixing sleeve 22, an induction heating unit 30 as a heating member for heating the fixing sleeve 22, and a pressing roller 23 as a pressing member for pressing the fixing sleeve 22.

Here, the fixing sleeve 22 includes a substrate formed of a metal material having a thickness from 30 μm to 50 μm. The substrate is covered with an elastic layer and a release layer, in this order. The outer diameter of the fixing sleeve 22 is 40 mm. As a material for forming the substrate of the fixing sleeve 22, iron, cobalt, nickel, or a magnetic material, such as an alloy of these metals, may be utilized. The elastic layer of the fixing sleeve 22 is formed of an elastic material, such as a silicone rubber, and its thickness is 150 μm. With such a configuration, heat capacity does not become so large, and a fine fixed image without unevenness can be obtained. Further, the release layer of the fixing sleeve 22 is formed by coating the elastic layer by a fluorine compound, such as PFA, in a tubular shape. The thickness of the release layer is 50 μm. The release layer is for improving a release characteristic of the toner on the surface of the fixing sleeve 22. Here, the toner T directly contacts the surface of the fixing sleeve 22.

The fixing roller 21 includes a core metal 21*a* formed of a metal material, such as a stainless steel, and having a cylindrical shape. The core metal 21*a* is covered with a heat-resistant elastic layer 21*b* formed of a silicone foam, and an outer diameter of the fixing roller 21 is about 40 mm. The elastic layer 21*b* of the fixing roller 21 has a thickness of 9 mm and it is formed so that its Asker hardness is within a range from 30 degrees to 50 degrees. The fixing roller 21 contacts an inner circumferential surface of the fixing sleeve 22, and supports the thin-layered fixing sleeve 22 in a roller shape.

The pressing roller 23 includes a core metal 23*a* formed of a high thermal conductive metal material, such as aluminum and copper. The core metal 23*a* is covered with a heat resistant elastic layer 23*b* and a release layer (not shown), in this order. The outer diameter of the pressing roller 23 is 40 mm. The elastic layer 23*b* is formed to have a thickness of 2 mm. The release layer is formed on the elastic layer 23*b* by covering with a PFA tube. The thickness of the release layer is 50 μm. The pressing roller 23 contacts and presses the fixing roller 21 through the fixing sleeve 22. A nip portion is formed at the pressed portion between the pressing roller 23 and the fixing roller 21. The sheet of recording medium P is conveyed to the nip portion.

The induction heating unit 30 includes, for example, an exciting coil 31, a core portion 32, and a degaussing coil unit 33. The exciting coil 31 is formed by winding litz wires, which are formed by bundling thin lines, around coil guides arranged to cover a part of an outer circumference of the fixing sleeve 22. The coil guides are extended in the width direction of the fixing sleeve 22 (the direction perpendicular to the paper surface of FIG. 2). The degaussing coil unit 33 is arranged to be symmetric in a positional direction corresponding to the width direction of the sheet of recording medium P. The degaussing coil unit 33 is arranged to overlap the exciting coil 31. The core portion 32 is formed of a ferromagnetic material (having a relative permeability of about 2500), such as a ferrite. The core portion 32 includes a center core 32*b* and a side core 32*a*, so as to form efficient magnetic flux toward the fixing sleeve 22. The core portion 32 is arranged to face the exciting coil 31 extended in the width direction of the fixing sleeve 22.

The fixing device 20 having such a configuration operates as follows. Namely, when the pressing roller 23 is rotationally driven in the clockwise direction in FIG. 2 by a driving motor (not shown), the fixing sleeve 22 is driven in the counterclockwise direction accordingly. At this time, the fixing roller 21 supporting the fixing sleeve 22 is not rotationally driven in a proactive manner. Then, the fixing sleeve 22, as a heating member and a fixing member, is heated by the magnetic flux generated by the induction heating unit 30 at a position facing the induction heating unit 30.

Specifically, when a high-frequency alternating current having a frequency in a range from 10 kHz to 1 MHz (preferably, from 20 kHz to 800 kHz) is applied to the exciting coil 31 from a power source (not shown), lines of magnetic force are formed, so that the lines of magnetic force are switched bidirectionally, in a neighborhood of the fixing sleeve 22 facing the exciting coil 31. In this manner, when the alternating magnetic fields are formed, eddy currents are generated on the substrate (heating layer) of the fixing sleeve 22, and joule heat is generated by the electric resistivity of the substrate. Thus, the substrate is inductively heated. Therefore, the fixing sleeve 22 is heated by the inductively heated substrate.

The portion of the surface of the fixing sleeve 22 heated by the induction heating unit 30 reaches the nip portion between the fixing sleeve 22 and the pressing roller 23. Then the toner image T supported on and to be fixed onto the sheet of recording paper (being conveyed) is heated and melted.

To be more precise, the sheet of the recording medium P supporting the toner image T, which has been formed through the above described image forming process, is guided by a guide plate 24 and enters the nip between the fixing sleeve 22 and the pressing roller 23 (the sheet moves in the conveyance direction indicated by the arrow Y1). Then the toner image T is fixed onto the sheet of the recording medium P by the heat from the fixing sleeve 22 and the pressure from the pressing roller 23. Subsequently, the sheet of the recording medium P is sent out from the nip portion while the sheet of the recording medium P is separated from the fixing sleeve 22 by a fixing separation plate 25 and a pressing separation plate 26. After passing through the nip portion, the portion of the surface of the fixing sleeve 22 reaches the position facing the induction heating unit 30 again. The overall configurations and the operations of the image forming device and the fixing device according to the embodiment have been explained above.

Hereinafter, some features of the embodiments are explained. First, a configuration and an operation according to a first embodiment are explained. The control unit, such as a CPU, mounted on the image forming device according to the first embodiment includes a gradation processing unit that processes a gradation of image information, and a fixing temperature varying unit that varies a target fixing temperature during a fixing process. Here, "the target fixing temperature during the fixing process" is a target fixing temperature during a time period between the start of the feeding of the sheet of the recording paper P to the fixing nip and the end of the feeding, namely, the time period in which the sheet of the recording medium P passes through the fixing nip (during feeding of the sheet, or during continuous feeding of sheets). The temperature during heating the fixing member, prior to starting supplying the sheet of the recording medium P to the fixing nip, is excluded from the target fixing temperature during the fixing process.

In the first embodiment, two types of methods, which are the dither method and the error diffusion method, are utilized as the gradation processing methods. The dither method is a method in which a grey-scale image is expressed by binary values (black and white). The dither method is similar to a usual binarization method. When the dither method is applied to an image using a threshold value, which is suitably varied, the image can be seen as if it were a gray scale image, when the image is viewed from far away, though the image is based on the binary values. On the other hand, the error diffusion method is a type of a method for smoothing an image by utilizing gradation processing. The error diffusion method is a method such that an error having occurred during processing of a pixel of a digital image is shared by the pixels surrounding the pixel, and the error as the whole image is minimized by subsequently performing the process while considering the effect of the sharing of the error.

Further, in the first embodiment, three temperatures are defined for the target fixing temperature, and one of the three temperatures is selected as the target fixing temperature by the fixing temperature varying unit. Usually, the target fixing temperature is selected as a value with which a failure, such as a failure on fixing the toner, does not occur in a sheet of a recording medium, even if an image having the worst condition for fixing is formed, provided that the same recording medium is utilized. Here, the target fixing temperature, which is to be selected for an image having the worst condition for fixing, is defined to be a normal temperature (a first target fixing temperature). Further, another target fixing temperature, which is slightly lower than the normal temperature, is defined to be a level 1 temperature (a second target fixing temperature), and the other target fixing temperature, which is much lower than the normal temperature, is defined to be a level 2 temperature (a third target fixing temperature). For example, the level 1 temperature is set to be 5 degrees Celsius lower than the normal temperature, and the level 2 temperature is set to be 10 degrees Celsius lower than the normal temperature.

Hereinafter, a method of controlling the target fixing temperature according to the first embodiment is explained by referring to the flowchart shown in FIG. 3. First, it is determined whether there is a halftone process for an image to be formed on the sheet of the recording medium P, prior to a sheet of the recording medium P being fed (STEP 1). The presence or absence of the halftone process is determined by CMYK values. Specifically, when images from a PC are to be printed, the RGB values (from 0% to 100%) in a display are converted into the CMYK values (from 0% to 100%) by printer image processing, and a print engine draws the images on a page-by-page basis. The presence or absence of the halftone process is determined by these CMYK values. When it is determined that there is no halftone process, for example, when K=100%, it is possible to select the lower target fixing temperature, since the image is solid and advantageous in the fixing property. Therefore, when it is determined that there is no halftone process, the level 2 temperature, which is quite lower than the normal temperature, is selected.

On the other hand, when it is determined that there is a halftone process, namely, when k=0 to 99%, the image is disadvantageous in the fixing property, and the target fixing temperature may not be lowered greatly. Further, in this case, a type of a gradation process used for forming the image is determined (STEP 2). When the error diffusion method is utilized as the halftone processing method, there are many isolated toner dots on the sheet of the recording medium. Hence, it is possible that the isolated toner dots will be removed after printing, unless the image is fixed at a sufficiently high temperature. Therefore, when it is determined that the type of the halftone process is the error diffusion method, since the target fixing temperature may not be lowered, the normal temperature, which is the usual target fixing temperature, is selected.

On the other hand, when the dither method is utilized, for example, the gradation is expressed by drawing lines. Thus there are fewer isolated dots, compared to the case in which the error diffusion method is utilized. However, it is disadvantageous in the fixing property to utilize the dither method, compared to the case in which there is no halftone process. Therefore, when it is determined that the dither method is utilized, the level 1 temperature is selected as the target fixing temperature.

In the first embodiment, the selection of the target fixing temperature is performed as described above. However, when plural sheets of the recording media P are continuously printed, the above process is performed for each sheet of the recording medium P, and the selection of the target fixing temperature is performed on a sheet-by-sheet basis.

Next, a control method according to a second embodiment is explained. In the second embodiment, a gradation process to be utilized is switched between a case of performing printer output in which a printer outputs image information received from an external device, such as a PC, and a case of performing copy output in which a scanner reads a manuscript and obtains image information and a copier outputs the image information. Specifically, for the printer output, the dither method is utilized, and for the copy output, the error diffusion method is utilized. Further, for the printer output, plural image forming modes are defined, so that at least one of the resolution of an image to be fixed and a level of a size of an image dot diameter can be varied. Specifically, the resolution of the image to be fixed is changed by changing the number of dots per unit area. For example, the number of the dots per 1 inch (dot density) is changed to 600 dpi or 1200 dpi. Further, the level of the size of the image dot diameter can be varied by changing the bit number. In the second embodiment, the image forming modes for the printer output include a speed prioritized general document mode in which the printing speed is given a priority, an image quality prioritized general document mode in which the quality of an image is given a priority, a photo mode (an image quality prioritized mode), and a high-resolution mode. In the above described modes, the resolution and the level of the size of the image dot diameter are defined as follows. Namely, for the speed prioritized general document mode, the resolution is 600 dpi and the level of the size of the image dot diameter is 1 bit. For the image quality prioritized general document mode, the resolution is 600 dpi and the level of the size of the image dot diameter is 2 bits. For the photo mode (the image quality prioritized mode) the resolution is 600 dpi and the level of the size of the image dot diameter is 2 bits. For the high-resolution mode, the resolution is 1200 dpi and the level of the size of the image dot diameter is 1 bit.

The speed prioritized general document mode is advantageous for the productivity. Since the number of the lines per inch is small, jags of a character or a line are visible. However, a time interval required for processing the image is short. In the image quality prioritized general document mode, a diffusion dither method is applied to text areas, and the number of the lines per inch is greater than that of the speed prioritized general document mode. In the image quality prioritized general document mode, the jags of the characters are improved compared to those of the speed prioritized general document mode. Further, since line dithering is applied to photo areas, the image quality prioritized general document mode is robust against color unevenness. However, since the image quality is prioritized, the productivity is lowered compared to the speed prioritized general document mode (for example, the time period from the input of an image to the completion of the printing is lengthened). For the (image quality prioritized) photo mode, the number of the lines per inch for a photo area is increased compared to that of the image quality prioritized general document mode. Thus, the resolution of the image becomes higher and the granularity is improved. Further, for the high-resolution mode, the number of the lines per inch in a photo area and the number of the lines per inch in a text area are further increased compared to those of the (image quality prioritized) photo mode. The high-resolution mode has the highest resolution in the second embodiment, and characters and outlines are very sharp.

The mode can be switched to another mode by a user through a control panel attached to the main body 100. Further, a paper type detection unit for detecting a type of a paper may be provided in the main body 100, and the mode can be switched to another mode, depending on the detected type of the paper, based on the detection information.

Further, the image forming device according to the second embodiment includes an area detection unit for detecting text areas and photo areas included in an image. For each of the above described four image forming modes, a type of the dither method and the number of the lines per inch are changed based on a detection result of the area detection unit. FIG. 4 shows specific examples of the types of the dither methods and the numbers of the lines per inch, which are utilized for the photo areas and the text areas in the corresponding image forming modes.

It has conventionally been known that a fixing property of a halftone image including many isolated dots is not good. However, the fixing property of a halftone image significantly differs depending on the type of the dither method applied. This is explained below.

Figure 5:
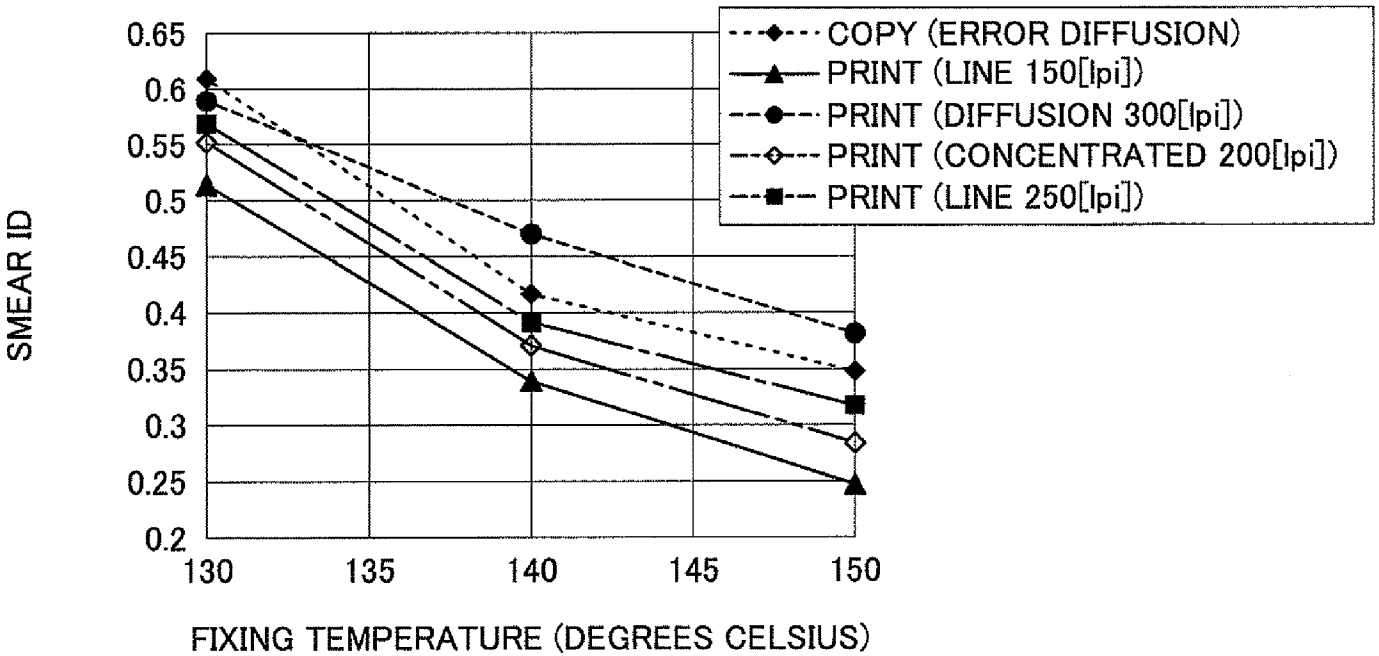
FIG. 5 is a diagram showing a fixing property of a halftone image with respect to each type of dithering method.

FIG. 5 is a diagram showing the fixing property of the halftone image with respect to various types of the dither methods. As an evaluation method, halftone images are output while using the various types of the gradation processing methods. At this time, as the image densities of the halftone, 11 samples are prepared. Here, the image densities (IDs) of the 11 samples are measured by the X-rite 938 produced by X-Rite, Incorporated, and the measured values of the image densities of the 11 samples are evenly incremented by 0.05, from 0.5 to 1.0. Further, as the fixing temperatures of the samples, three temperatures of 130 degrees Celsius, 140 degrees Celsius, and 150 degrees Celsius are defined.

Then, smear resistance is measured for each sample. Here, the smear resistance is used as a method of determining the fixing property of a copied image and/or a printed image. The smear resistance may be used for measuring easiness for pealing the toner in the halftone image. A method of measuring the smear resistance is described below.

A sample of a halftone image is rubbed by reciprocating a white cotton cloth 5 times under a predetermined load. Here, the sample has a base image density (ID) of 0.75±0.1, according to the spectral densitometer produced by X-Rite, Incorporated. Then a density of a portion of the white cotton cloth, where the toner is adhered to, is measured with the spectral densitometer. A higher density of the white cotton cloth, after rubbing, means that the toner is more easily peeled off from the paper. Thus it is determined that the fixing property of the toner is not good, when the density of the white cotton cloth is high. Here, a smear image density (ID) value for the fixing property of the halftone process is defined to be the largest smear ID value among the smear ID values of the samples, for which the same fixing temperature and the same image processing information have been applied. In FIG. 5, the smear ID values are plotted for various types of halftone processes. Here, the vertical axis represents the smear ID value, and the horizontal axis represents the fixing temperature. The graph of FIG. 5 shows that the fixing property becomes worse, as the smear ID value becomes greater.

In the graph of FIG. 5, the fixing properties for almost all the corresponding types of the dither methods for the printer output are better than the fixing property of the error diffusion method for the copy output. However, for the case of the diffusion dither method, which is commonly used for characters in the printer output, the fixing property is lower than the fixing property for the copy output. As described above, whether the fixing property is good or bad is not simply determined by a single factor, such as whether the printer output is performed or the copy output is performed. Therefore, it is preferable to control the fixing temperature in accordance of the fixing property of an output image.

Therefore, in the method of controlling the target fixing temperature in the second embodiment, when the dither method is used as a gradation process, in addition to the control flow similar to the control flow of the first embodiment, the target fixing temperature is varied based on the type of the dither method and the line density.

FIG. 6 is a diagram showing the target fixing temperatures which are selected depending on the type of the dither method and the number of the lines per inch, when the dither method is utilized as a halftone processing method, based on the result of reviewing the graph of FIG. 5. Here, the normal temperature and the level 1 temperature are the same as the corresponding target fixing temperatures described above. In the example shown in FIG. 6, when the number of the lines per inch (line density) is less than or equal to 200 lpi, the target fixing temperature is lowered to the level 1 temperature for the concentrated dither and the line dither. Further, when the diffusion dither method is utilized and the number of lines per inch is greater than or equal to 200 lpi, the target fixing temperature is always set to the normal temperature.

Further, FIG. 7 shows the target fixing temperatures for the corresponding image forming modes for the photo area and the text area, depending on the presence or absence of a halftone image, based on FIGS. 4 and 6. In FIG. 7, the case in which there is no halftone image is indicated by "100% image only" (solid image only), and the case in which there is the halftone image is indicated by "less than 100% image exists."

Hereinafter, the method of controlling the target fixing temperature according to the second embodiment is explained by referring to the flowchart of FIG. 8. In the second embodiment, the target fixing temperatures are divided into the three temperatures, namely, the normal temperature, the level 1 temperature, and the level 2 temperature, similarly to the first embodiment.

Figure 3:
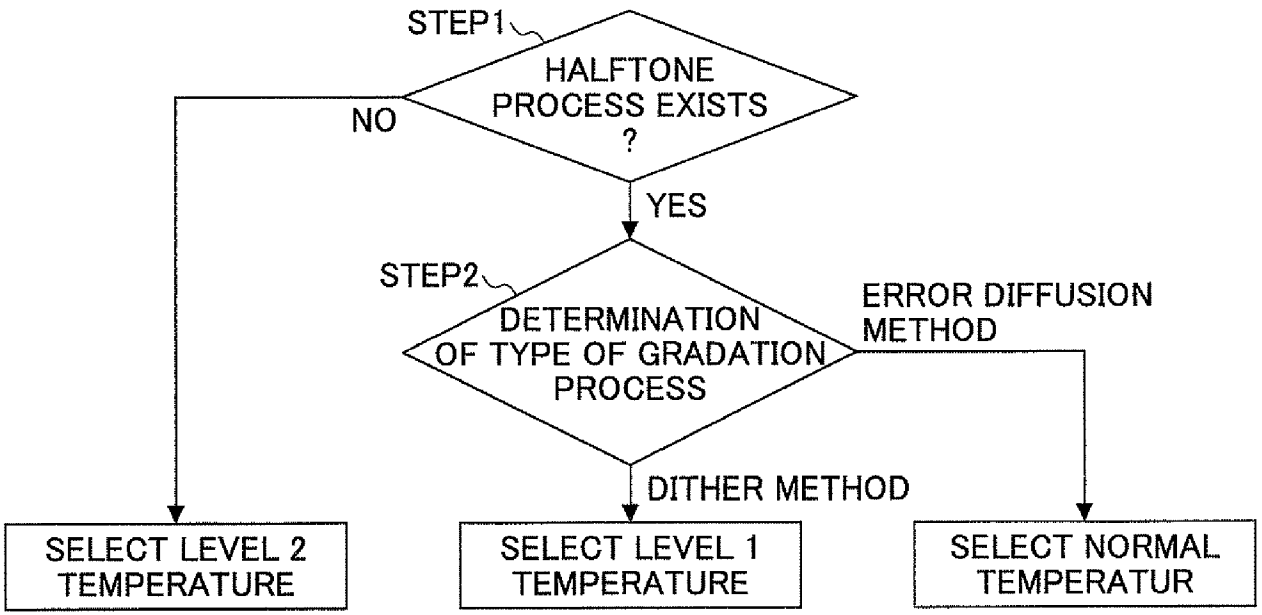
FIG. 3 is a flowchart illustrating a method of controlling a target fixing temperature according to a first embodiment.
Figure 8:
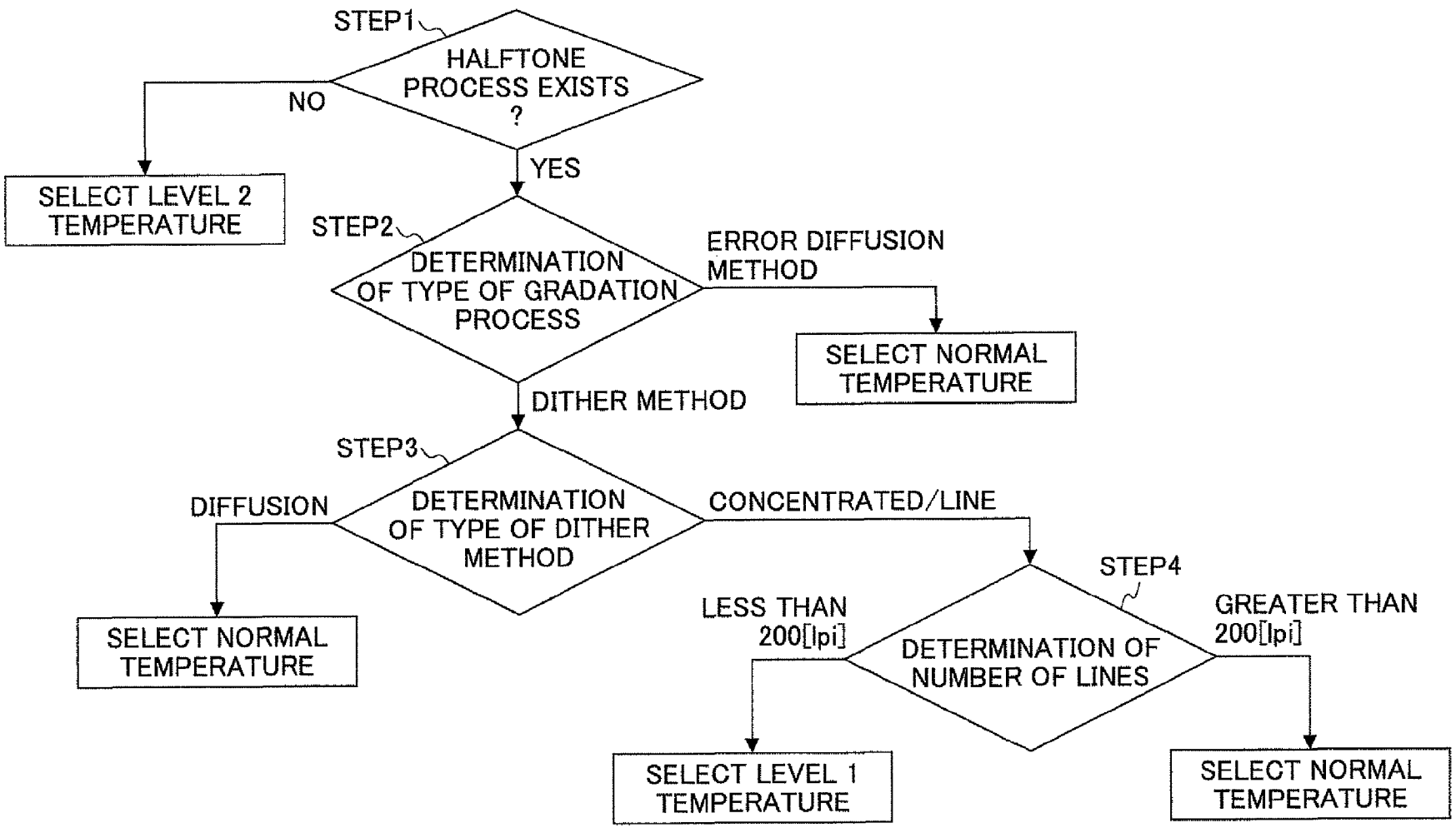
FIG. 8 is a flowchart illustrating a method of controlling the target fixing temperature according to a second embodiment.

In FIG. 8, flows of STEP 1 and STEP 2 are the same as the flows of STEP 1 and STEP 2 according to the first embodiment, which are indicated in the flowchart of FIG. 3. Therefore, the explanations of the flows of STEP 1 and STEP 2 are omitted, and only the points that are different from that of the first embodiment are explained. At STEP 2 in FIG. 8, when it is determined that the type of the gradation process is the dither method, the type of the dither method is determined (STEP 3). When it is determined that the diffusion dither method is utilized, the normal temperature is selected as the target fixing temperature. That is because, the diffusion dither method is less advantageous in the fixing property, compared to those of other dither methods (the concentrated dither method and the line dither method), even if the number of the lines per inch are the same. Therefore, the target fixing temperature may not be lowered.

On the other hand, when it is determined that a dither method other than the diffusion dither method (the concentrated dither method or the line dither method) is utilized, the number of the lines per inch is further determined (STEP 4). When it is determined that the number of the lines per inch is less than 200 lpi, since it is relatively advantageous in the fixing property, the level 1 temperature, which is slightly lower than the normal temperature, is selected. On the other hand, when it is determined that the number of the lines per inch is greater than or equal to 200 lpi, since it is disadvantageous in the fixing property, the normal temperature is selected.

The method of controlling the target fixing temperature according to the second embodiment has been explained above. Further, in the second embodiment, when plural sheets of the recording media P are continuously printed, the above process is performed on a sheet-by-sheet basis, and the target fixing temperature is selected for each sheet of recording media P. In this manner, in the second embodiment, when the type of the gradation process to be utilized is the dither method, further energy reduction can be achieved while a fine fixing property is ensured, by setting the target fixing temperature, depending on the type of the dither method and the line density.

Next, a control method according to a third embodiment is explained. In the third embodiment, the target fixing temperature is selected by determining whether the image to be formed is a monochrome image or a full color image and whether the image includes a text area and/or a photo area.

Hereinafter, the method of controlling the target fixing temperature according to the third embodiment is explained by referring to the flowcharts shown in FIGS. 9-11. In the third embodiment, the target fixing temperatures are divided into three temperatures, namely, the normal temperature, the level 1 temperature, and the level 2 temperature, similar to the above embodiments.

Figure 9:
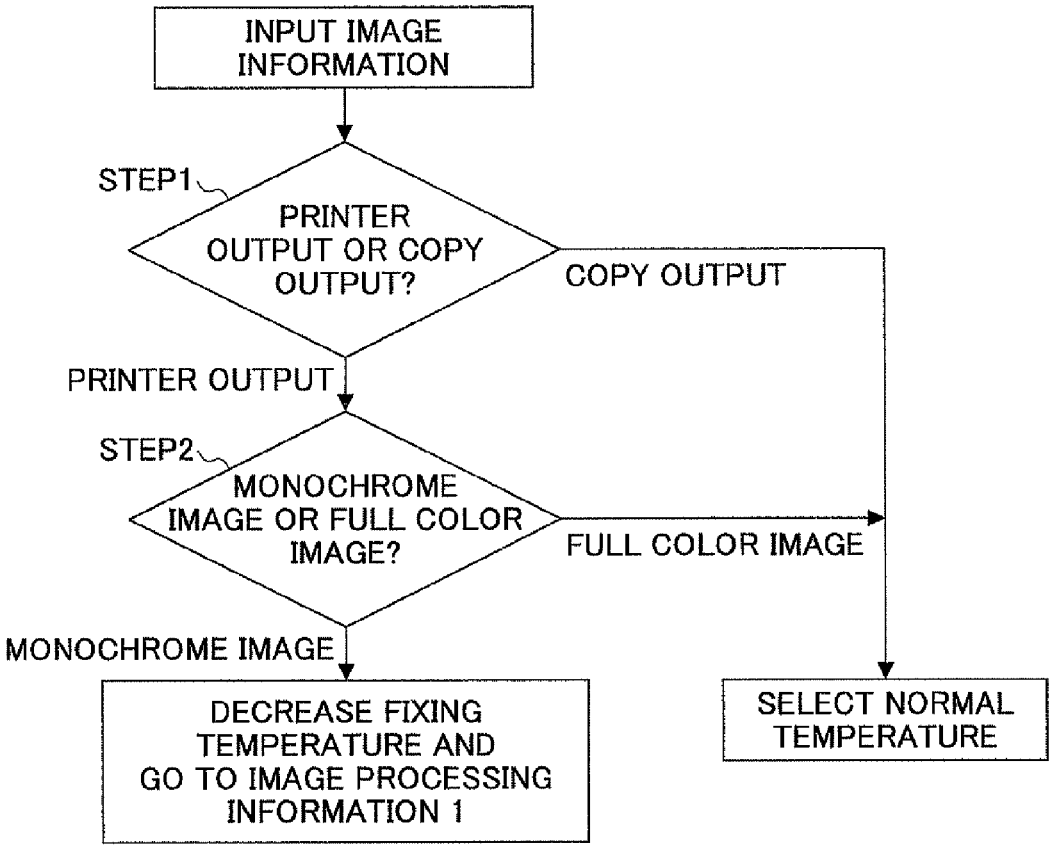
FIG. 9 is a flowchart illustrating a method of controlling the target fixing temperature according to a third embodiment.

First, as shown in FIG. 9, it is determined whether the process is the printer output or the copy output, based on input image information (STEP 1). In the third embodiment, when the process is the printer output, the dither method is utilized, and when the process is the copy output, the error diffusion method is utilized, similar to the above embodiments. Namely, the type of the gradation process is determined by determining whether the process is the printer output or the copy output. When it is determined that the process is the copy output, since the error diffusion method is utilized, the target fixing temperature may not be lowered, and the normal temperature is selected, as described above. Here, even if the error diffusion method is utilized as the halftone processing method, the target fixing temperature may be controlled depending on a size of a dot or the presence or absence of a halftone image.

On the other hand, when it is determined that the process is the printer output, it is further determined whether an image to be formed is a monochrome image or a color image (STEP 2). When the image is the monochrome image, since the dither method is utilized as the gradation processing method, it is determined whether it is possible to lower the target fixing temperature, depending on the type of the dither method and the number of the lines per inch, by obtaining the following image processing information 1. This is because, the lower limit for the fixing temperature of the monochrome image has been defined by the smear resistance. Namely, it is possible that a monochrome image includes a lesser amount of isolated toner dots, depending on the type of the dither method, such as the line dither method, or the concentrated dither method. Therefore, when the monochrome image includes a lesser amount of the isolated toner dots and is advantageous in the smear resistance of the halftone, it is possible to lower the target fixing temperature.

Further, the dither method is utilized as the gradation processing method for the case of a full color image. However, it is possible that 2 or more colors are superposed in the full color image. Therefore, an amount of the adhered toner for the full color image is greater than that of the monochrome image. For a full color image, the fixing property of the solid drawing or the cold offset defines a processing speed, rather than the smear resistance. Therefore, when it is determined that the image to be formed is a full color image, the normal temperature is selected, without lowering the target fixing temperature. Here, even if the image to be formed is the full color image, it is possible to add a control for varying the target fixing temperature, depending on an adhering amount of the toner.

Figure 10:
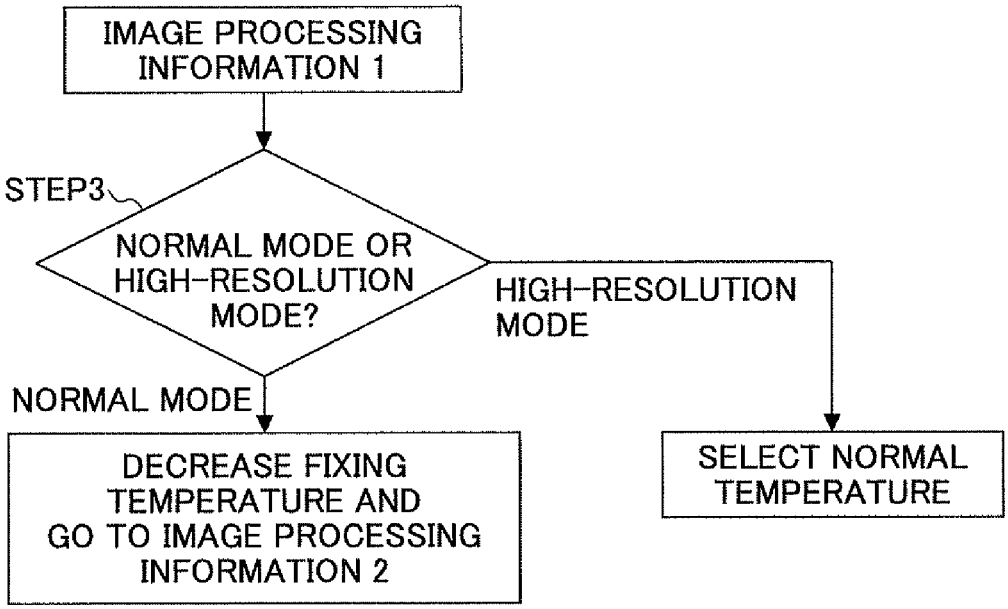
FIG. 10 is a flowchart illustrating the method of controlling the target fixing temperature according to the third embodiment.

Next, the process shown in FIG. 10 is explained. In the process, it is determined whether the target fixing temperature may be lowered from the normal temperature, when the image to be formed is the monochrome image, by obtaining the image processing information 1. As shown in FIG. 10, in the process, it is determined whether the image forming mode for forming the image is a normal mode or the high-resolution mode (STEP 3). Here, the high-resolution mode is the same as the high-resolution mode which has been described above. The normal mode is any of the above described image forming modes other than the high-resolution mode (the speed prioritized general document mode, the image quality prioritized general document mode, or the photo mode; cf. FIG. 4).

When it is determined that the image forming mode is the high-resolution mode, since the number of the lines per inch is large, the normal temperature, for which the target fixing temperature is not lowered, is selected. Here, even if the image forming mode is the high-resolution mode, the target fixing temperature may be lowered, provided that it is determined that the image does not include halftone. On the other hand, when it is determined that the image forming mode is the normal mode, there is some likelihood that the target fixing temperature can be lowered. Therefore, it is determined whether the target fixing temperature can be lowered, by obtaining the following image processing information 2.

Figure 11:
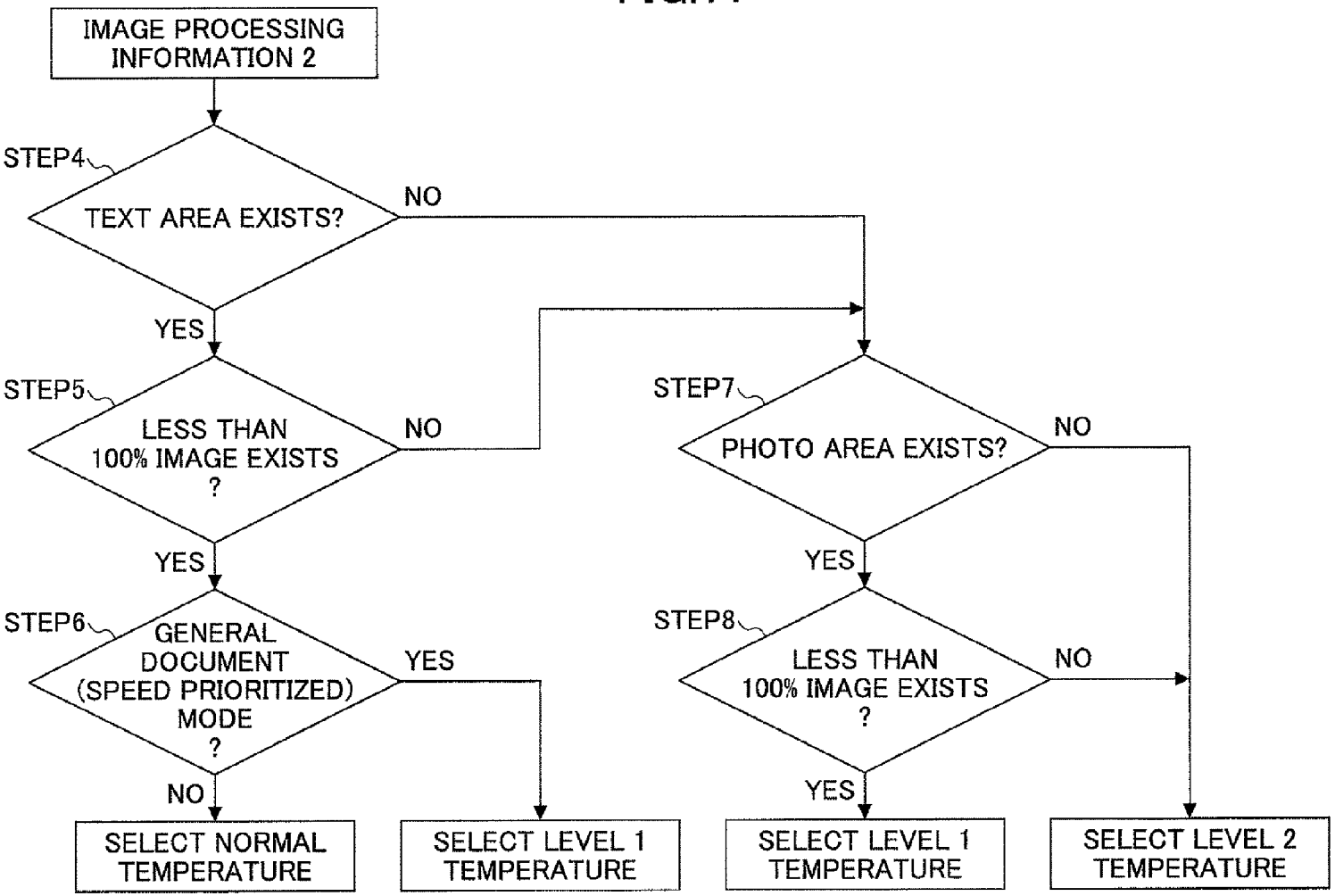
FIG. 11 is a flowchart illustrating the method of controlling the target fixing temperature according to the third embodiment.

Next, a process of FIG. 11 is explained. In the process, when the image forming mode is the normal mode, it is determined whether the target fixing temperature can be lowered from the normal temperature, by obtaining the image processing information 2. As shown in FIG. 11, in the process, first, it is determined whether the image includes a character area (STEP 4). When it is determined that the character area is included in the image, subsequently, it is determined whether the image includes a less than 100% image (presence or absence of a halftone process) (STEP 5). When it is determined that the less than 100% image is included in the image, it is further determined whether the image forming mode is the speed prioritized general document mode (STEP 6).

Here, when the image forming mode is the speed prioritized general document mode, the concentrated dither method is utilized, similar to the above described case. On the other hand, when the image forming mode is the image quality prioritized general document mode or the photo mode, the diffusion dither method is utilized (cf. FIG. 4). Therefore, when the image includes the character area, the character area includes the less than 100% image, and the image forming mode is the speed prioritized general document mode, the concentrated dither method is utilized. When the concentrated dither method is utilized, fewer of the isolated toner dots are produced. Therefore, the target fixing temperature can be slightly lowered, and the level 1 temperature may be selected as the target fixing temperature.

On the other hand, when the image includes the text area, the text area includes the less than 100% image, and the image forming mode is any of the image forming mode other than the speed prioritized general document mode, the diffusion dither method is utilized. The diffusion dither method is disadvantageous for the fixing property. Therefore, the target fixing temperature is not lowered, and the normal temperature is selected.

Further, when it is determined, at STEP 4 or STEP 5, that the image does not include the text area or that the text area does not include the less than 100% image, it is determined whether the image includes a photo area (STEP 7). When it is determined that the image includes the photo area, it is further determined whether the photo area includes a less than 100% image (STEP 8). When it is determined that the image includes the photo area and that the photo area includes the less than 100% image, the line dither method is utilized, similar to the above described case (cf. FIG. 4). Thus, the image includes fewer of the isolated toner dots, and the target fixing temperature can be slightly lowered. Therefore, the level 1 temperature is selected as the target fixing temperature. On the other hand, when it is determined, at STEP 7 or STEP 8, that the image does not include a photo area or that the photo area does not include a less than 100% image, the level 2 temperature is selected as the target fixing temperature. In this case, since the image is a solid image and does not include a halftone image, a the target fixing temperature can be significantly lowered. Here, whether the image is the solid image of 100% is determined based on the CMYK value of the image, as explained above.

The method of controlling the target fixing temperature according to the third embodiment has been described above. However, in the third embodiment, when plural sheets of the recording media P are continuously printed, the target fixing temperature for each sheet of the recording media P can be set to be a suitable temperature, by performing the above described process on a sheet-by-sheet basis.

Further, low-temperature fixing toner may be utilized as the black toner. Hereinafter, a method of controlling the target fixing temperature is explained for the case in which the low-temperature fixing toner is utilized as the black toner. Details of the toner utilized in the fourth embodiment are explained later.

Figure 12:
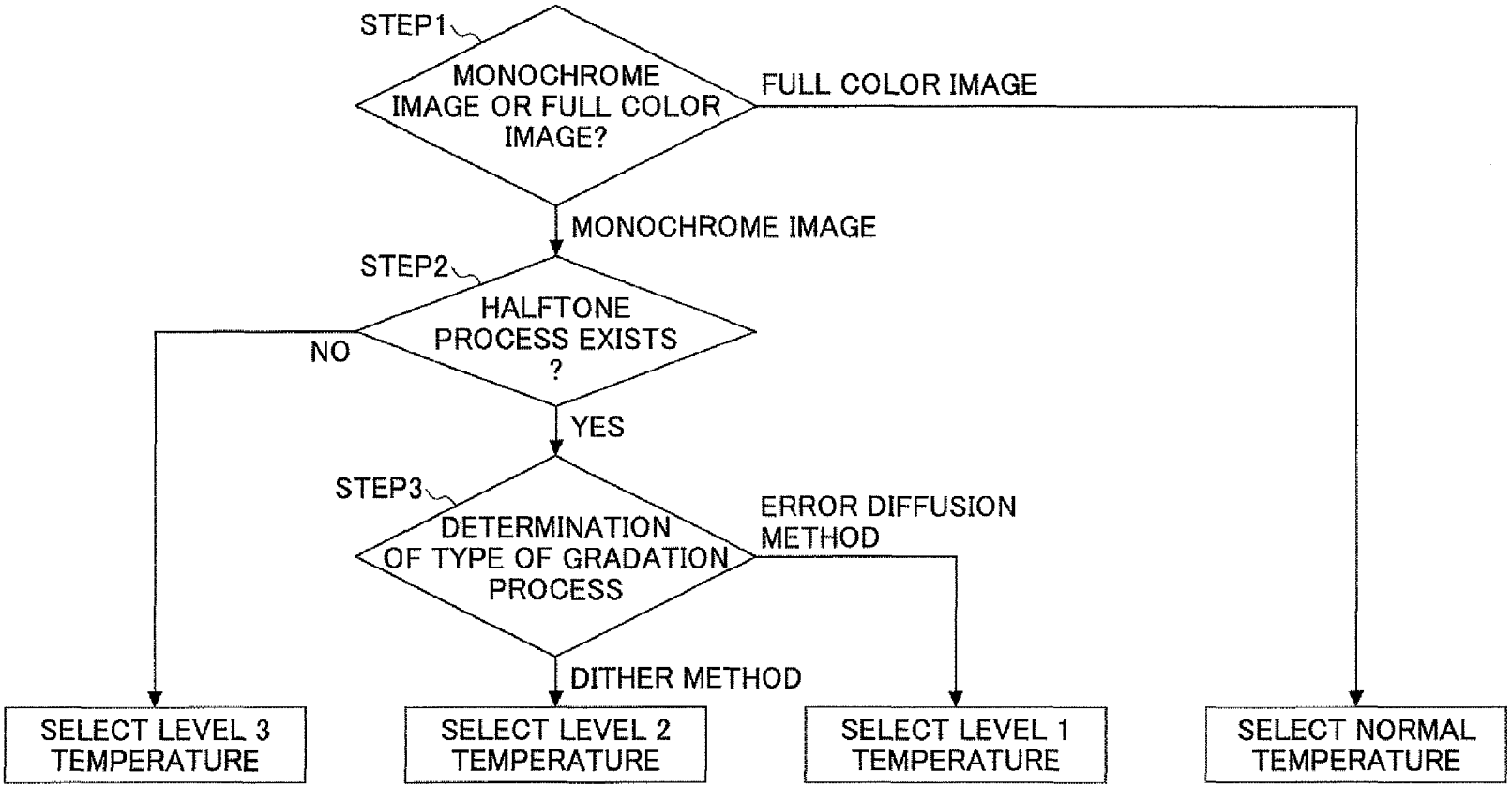
FIG. 12 is a flowchart illustrating a method of controlling the target fixing temperature according to a fourth embodiment.

FIG. 12 is a flowchart of the controlling method according to the fourth embodiment, in which the low-temperature fixing toner is utilized as the black toner. In the fourth embodiment, 4 temperatures are defined as the target fixing temperatures. One of the four temperatures is selected as the target fixing temperature by a target fixing temperature varying unit. Specifically, the target fixing temperature for a full color image is defined to be the normal temperature (the first target fixing temperature). Here, the full color image is the most disadvantageous image for fixing. On the other hand, when the image is the monochrome image, the target fixing temperature can be lowered, compared to the case of the full color image. Therefore, for the case of the monochrome image, three temperatures are defined as the target fixing temperatures. Namely, the level 1 temperature (the second target fixing temperature), which is slightly lower than the normal temperature, the level 2 temperature (the third target fixing temperature), which is slightly lower than the level 1 temperature, and the level 3 temperature (the fourth target fixing temperature), which is significantly lower than the level 1 temperature, are defined as the target fixing temperatures. For example, the level 1 temperature is 10 degrees Celsius lower than the normal temperature, the level 2 temperature is 15 degrees Celsius lower than the normal temperature, and the level 3 temperature is 25 degrees Celsius lower than the normal temperature.

As shown in FIG. 12, in the target fixing temperature control according to the fourth embodiment, it is determined, at STEP 1, whether an image to be formed on a sheet of the recording medium P is a monochrome image or a full color image. When it is determined that the image is the full color image, the normal temperature is selected as the target fixing temperature, as described above. On the other hand, when the image is the monochrome image, it is possible to lower the target fixing temperature. Thus, the determination at STEP 2 and/or the determination at STEP 3 is performed.

At STEP 2, it is determined whether a halftone process is included in the process of the image. Further, depending on the result of the determination, subsequently, the type of the gradation process, which is utilized for forming the image, is determined at STEP 3. Here, since the flowchart of STEP 2 and STEP 3 are the same as the flowchart of STEP 1 and STEP 2 shown in FIG. 3, the explanation of the flowchart of STEP 2 and STEP 3 is omitted. However, in the flowchart shown in FIG. 12, the target fixing temperatures that are set after the processes of STEP 2 and STEP 3 are lowered by one level, compared to those of the flowchart shown in FIG. 3.

Further, when plural sheets of the recording media P are continuously printed, the target fixing temperature is set for each sheet of the recording medium P, by performing the above described process on a sheet-by-sheet basis. As described above, with the configuration in which the low-temperature fixing toner is utilized as the black toner, the target fixing temperature for the monochrome image can be set to be a lower temperature, compared to that of the full color image, by utilizing the method of controlling the target fixing temperature shown in FIG. 12. Therefore, the energy consumption can be reduced while the fine fixing property is ensured.

Next, a control method according to a fifth embodiment, in which the low-temperature fixing toner is utilized as the black toner, is explained. In the fifth embodiment, when the type of the gradation process to be utilized is the dither method, the target fixing temperature is set based on the type of the dither method and the number of the lines per inch, in addition to the method shown in FIG. 12.

In FIG. 13, the target fixing temperatures for the corresponding image forming modes are indicated for a case in which the full-color printing is performed and for a case in which the monochrome printing is performed, respectively. The target fixing temperatures are indicated for the photo area and for the text area, depending on the presence or absence of a halftone image. Here, the normal temperature, the level 1 temperature, the level 2 temperature, and the level 3 temperature indicated in FIG. 13 are the same as those of FIG. 12. The tables of FIG. 13 are produced based on FIG. 4 and FIG. 6. The settings of the type of the dither method, the resolution, and the level of the size of the image dot diameter for the corresponding image forming modes in FIG. 13 are the same as those of the settings described above.

Figure 14:
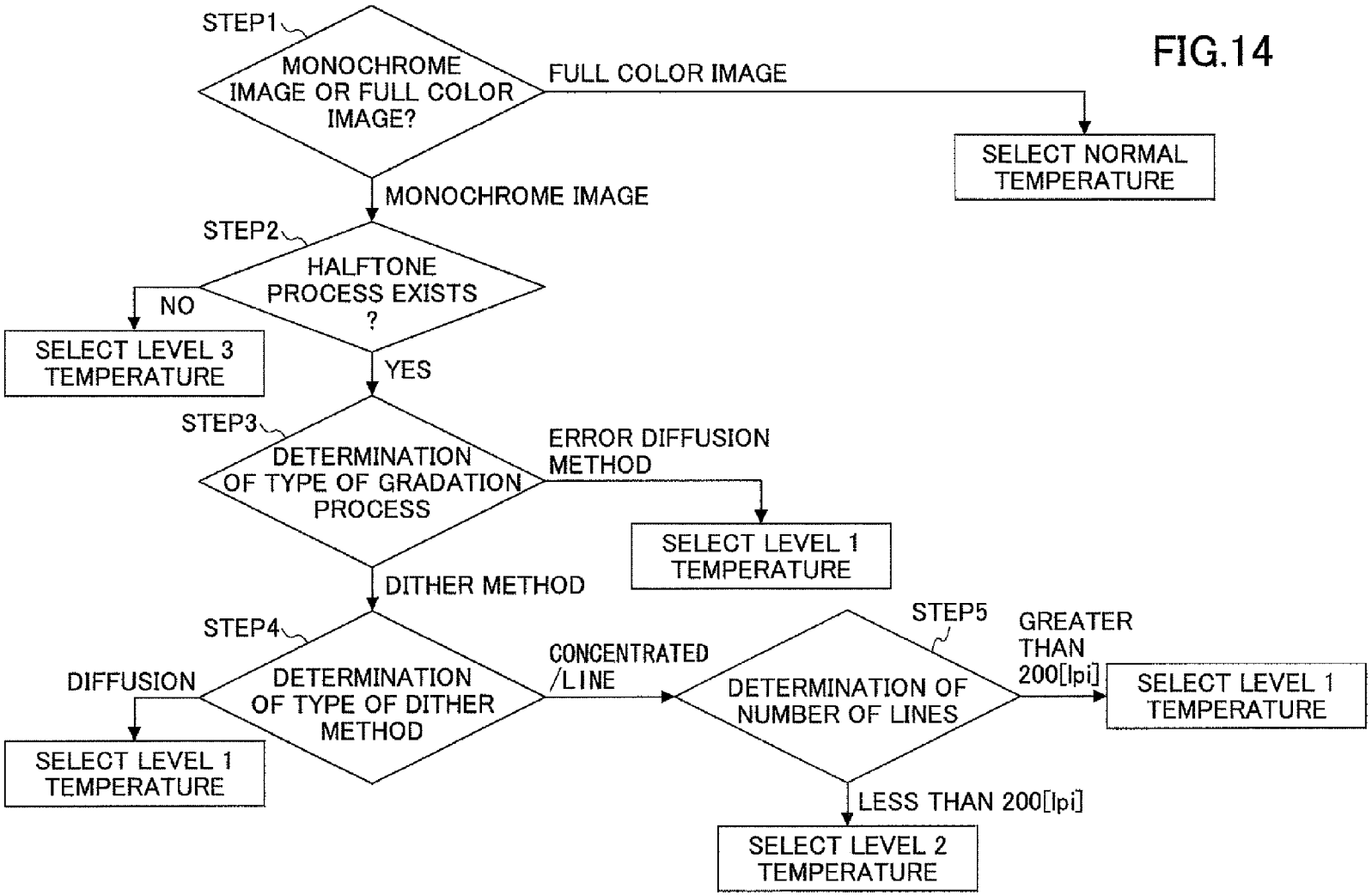
FIG. 14 is a flowchart illustrating a method of controlling the target fixing temperature according to the fifth embodiment.

FIG. 14 is a flowchart of a control method according to a fifth embodiment. As shown in FIG. 14, in the target fixing temperature control according to the fifth embodiment, first, it is determined, at STEP 1, whether an image to be formed on a sheet of the recording medium P is a monochrome image or a full color image. When it is determined that the image to be formed is the full color image, the normal temperature is selected as the target fixing temperature, as described above. On the other hand, when it is determined that the image to be formed is the monochrome image, the determination of on and after STEP 2 are performed, as it is possible to lower the target fixing temperature.

Here, since the flowchart of STEP 2 through STEP 5 shown in FIG. 14 is the same as that of STEP 1 through STEP 4 shown in FIG. 8, the explanation of the flowchart of STEP 2 through STEP 5 shown in FIG. 14 is omitted. However, in the flowchart shown in FIG. 14, the target fixing temperatures, which are set after the processes of STEP 2 through STEP 5, are lowered by one level, compared to those of the flowchart shown in FIG. 8.

Further, when plural sheets of the recording media P are continuously printed, the target fixing temperature is set for each sheet of the recording media P, by performing the above process on a sheet-by-sheet basis. As described above, in the fifth embodiment, when the type of the gradation process to be utilized is the dither method, the target fixing temperature is set based on the type of the dither method and the line density. In this manner, the energy consumption can be further reduced, while the fine fixing property is ensured.

Figure 15:
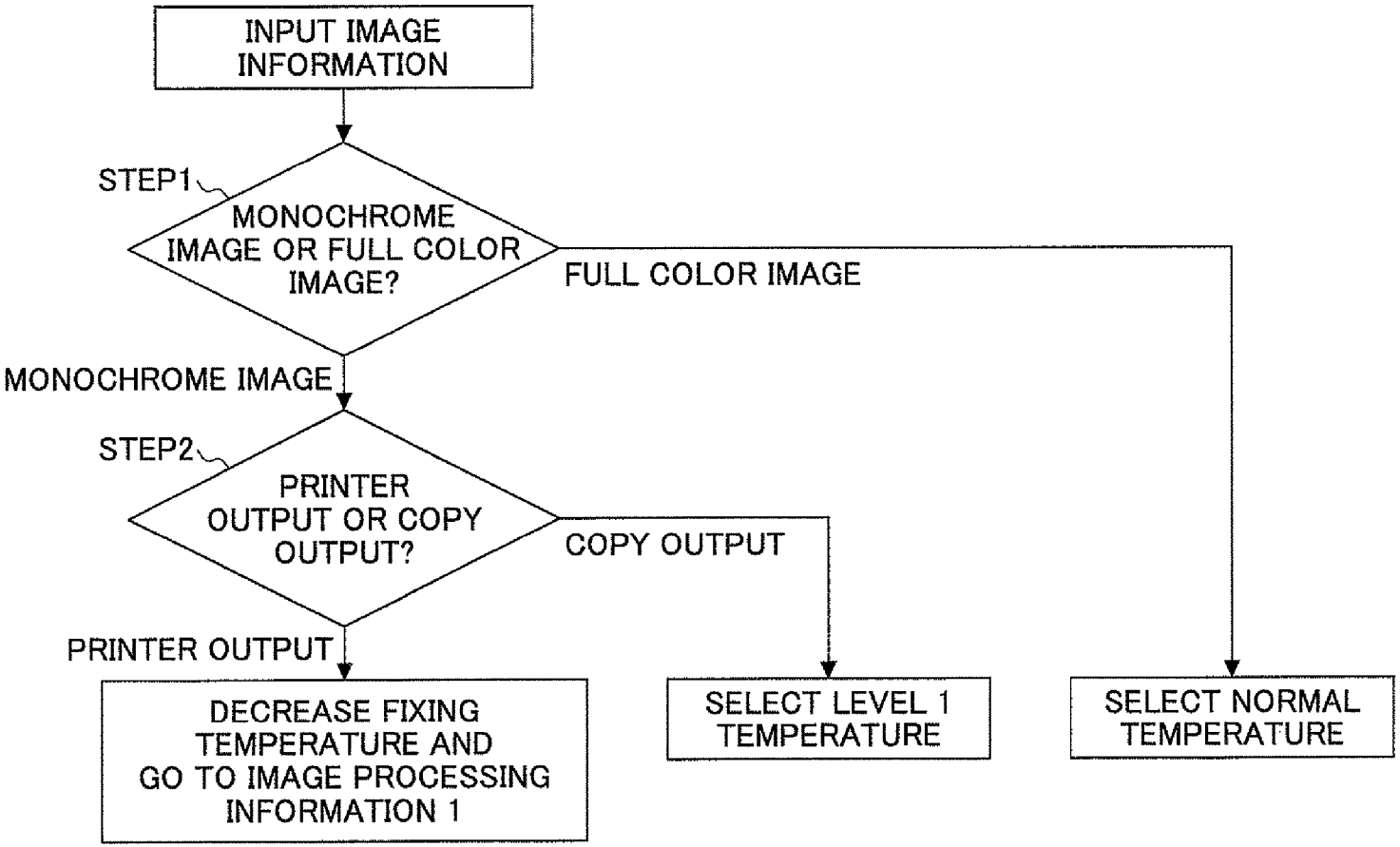
FIG. 15 is a flowchart illustrating a method of controlling the target fixing temperature according to a sixth embodiment.
Figure 16:
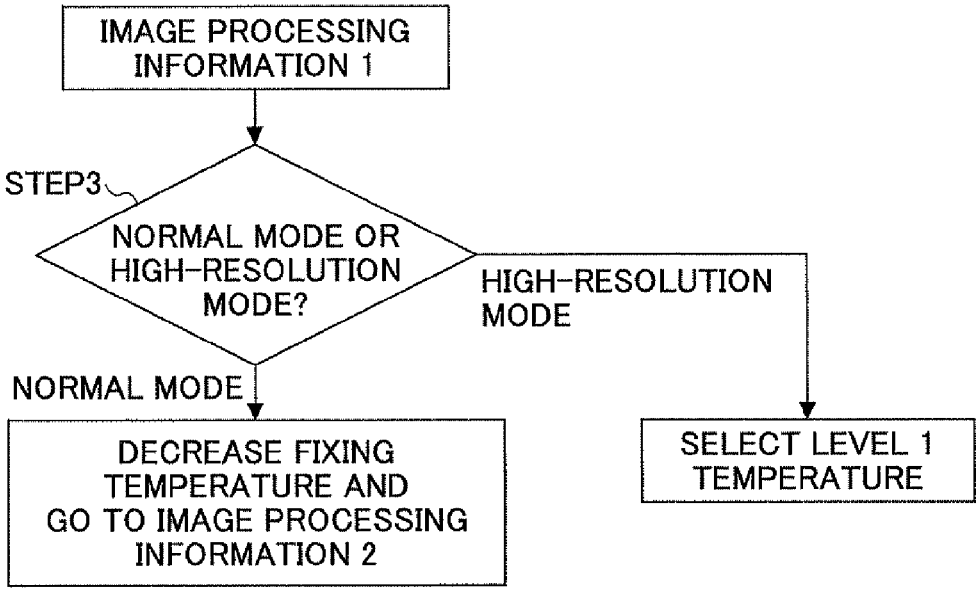
FIG. 16 is a flowchart illustrating the method of controlling the target fixing temperature according to the sixth embodiment.
Figure 17:
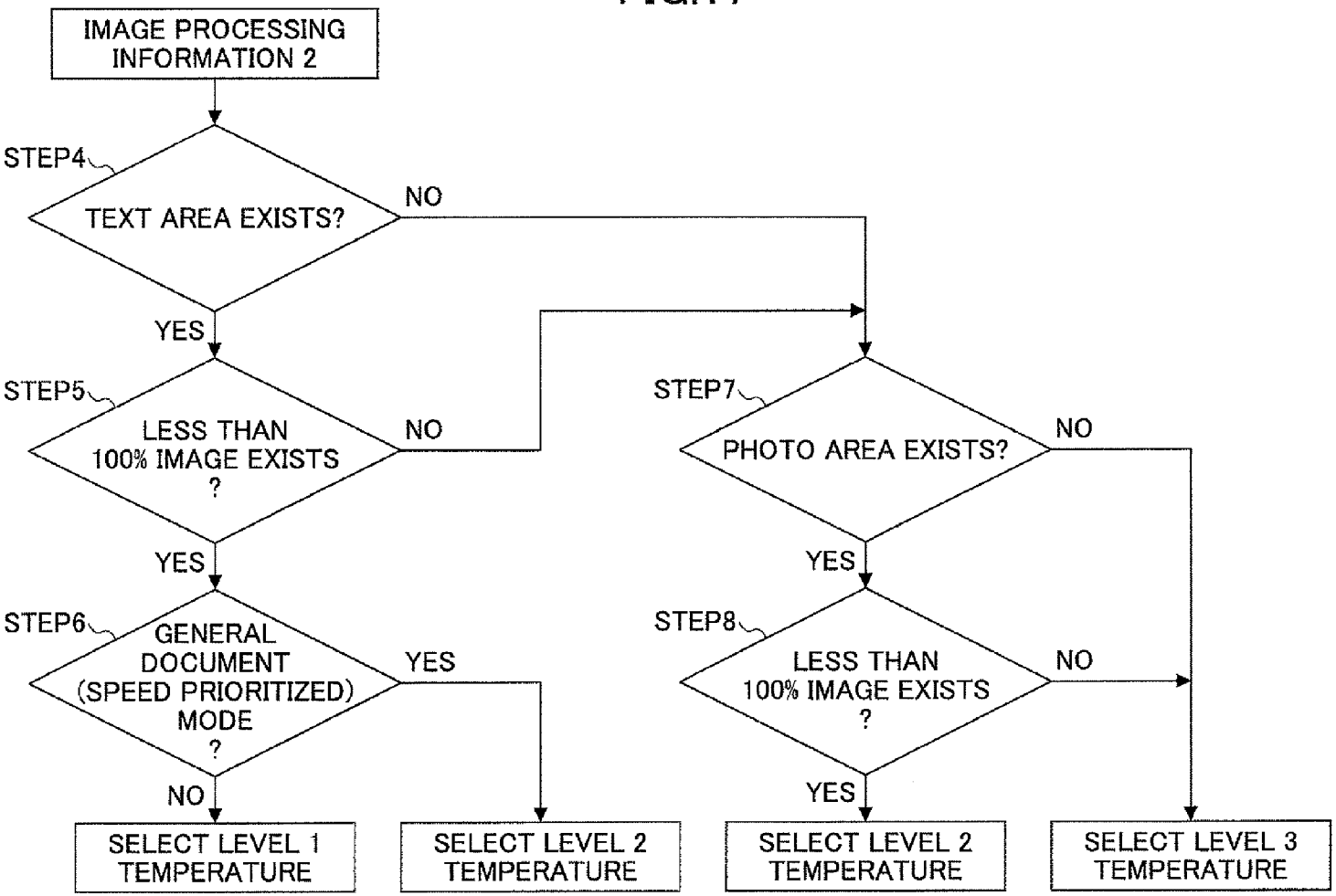
FIG. 17 is a flowchart illustrating the method of controlling the target fixing temperature according to the sixth embodiment.

FIGS. 15-17 are flowcharts of a control method according to a sixth embodiment, in which the low-temperature fixing black toner is utilized. In the sixth embodiment, the target fixing temperatures are divided into 4 temperatures, namely, the normal temperature for forming the color image, the level 1 temperature, the level 2 temperature, and the level 3 temperature for forming the monochrome image.

In the target fixing temperature control according to the sixth embodiment, as shown in FIG. 15, first, it is determined whether an image to be formed on a sheet of the recording medium P is a monochrome image or a full color image. When it is determined that the image to be formed is the full color image, the normal temperature is selected as the target fixing temperature, as described above. On the other hand, when it is determined that the image to be formed is the monochrome image, the determination on and after STEP 2 is performed, as it is possible to lower the target fixing temperature.

At STEP 2, it is determined whether the process is the printer output or the copy output, based on the input image information. When it is determined that the process is the copy output, since the error diffusion method is utilized, the target fixing temperature may not be lowered at a time of forming the monochrome image. Therefore, the level 1 temperature is selected. Here, even if the error diffusion method is utilized as a gradation processing method, the target fixing temperature may be controlled based on the size of the dots and the presence or absence of the halftone. On the other hand, when it is determined that the process is the printer output, the process proceeds to a step of determining whether the target fixing temperature can be lowered from the level 1 temperature by obtaining the image processing information 1.

FIG. 16 shows a flowchart of a process of selecting the target fixing temperature by obtaining the image processing information 1. Further, FIG. 17 shows a flowchart of a process of selecting the target fixing temperature by obtaining the image processing information 2, after the process shown in FIG. 16. Since the flowcharts shown in FIGS. 16 and 17 are the same as those of FIGS. 10 and 11, the explanation of the flowcharts of FIGS. 16 and 17 is omitted. However, in the flowcharts shown in FIGS. 16 and 17, the target fixing temperatures to be set are lowered by one level, compared to those of the flowcharts shown in FIGS. 10 and 11.

Further, in this case, when plural sheets of the recording media P are continuously printed, the target fixing temperature is set for each sheet of the recording media P, by performing the above process on a sheet-by-sheet basis. In this manner, the target fixing temperature can be set to be a suitable temperature for each sheet of the recording media P.

Hereinafter, a configuration is explained, with which further reduction of the energy consumption can be achieved. Operation modes of an image forming device having this configuration include a normal image forming mode that prioritizes image quality (or an image quality prioritized mode) and an energy saving prioritized mode that prioritizes the reduction of the energy consumption by changing the image quality. A user or the like can choose one of these modes, depending on whether the image quality is prioritized or the reduction of the energy consumption is prioritized.

In the normal image forming mode, a type of the dither method to be utilized for forming an image is predefined. On the other hand, in the energy saving prioritized mode, the predefined type of the dither method is switched to another type of the dither method, which is more advantageous for fixing the image. Specifically, the type the dither method utilized for the text area in the image quality prioritized general document mode and the photo mode (the image quality prioritized mode) shown in FIG. 4 is switched from the predefined diffusion dither method to the line dither method for a photograph, which is advantageous for fixing the image.

When the target fixing temperature in the energy saving prioritized mode is set in this condition, the target fixing temperature for the text area for the case in which the less than 100% image exists in the image quality prioritized general document mode and the photo mode (the image quality prioritized mode) is switched from the normal temperature to the level 1 temperature shown in FIG. 18 (the portions surrounded by the double frames are the changed portions).

Therefore, in this case, if the image forming mode selected by the user or the like is the image quality prioritized general document mode or the photo mode (the image quality prioritized mode), and, at the same time, the image forming mode selected by the user or the like is the energy saving prioritized mode, further reduction of the energy consumption may be achieved, as the target fixing temperature is set to be a lower temperature for forming a predetermined image, compared to the normal image forming mode. Further, if the user or the like would like to prioritize using the image quality, the user or the like may select the normal image forming mode.

Further, the fixing property of an image may be varied by changing the number of the lines per inch utilized for the image. Therefore, in the energy saving prioritized mode, a predefined number of lines per inch may be switched to another number of lines per inch, which is more advantageous for fixing the image. Specifically, the predefined number of the lines per inch for the high-resolution mode in FIG. 4 is switched to the number of the lines per inch for the photo mode (the image quality prioritized mode), which is more advantageous for fixing the image. Namely, for the high-resolution mode, the number of the lines per inch used for the photo area is switched from 250 lpi to 200 lpi, and the number of the lines per inch used for the text area is switched from 600 lpi to 300 lpi.

When the target fixing temperature is set in the energy consumption prioritized mode in this condition, the target fixing temperatures for the high resolution mode shown in FIG. 7 are switched from the normal temperature to the level 1 temperature or the level 2 temperature shown in FIG. 19 (the portions surrounded by the double frames in FIG. 19 are the changed portions).

Therefore, in this case, if the user or the like selects the high-resolution mode and the energy saving prioritized mode as the image forming mode, the target fixing temperature is set to be a lower temperature for a predetermined image, compared to that of the normal image forming mode. Therefore, further reduction of the energy consumption may be achieved, similar to the above described case.

Further, in the energy saving prioritized mode, both the type of the dither method and the number of the lines per inch may be changed to another type of the dither method and another number of the lines per inch that are more advantageous for fixing the image. For example, similar to the above example, the type of the dither method utilized for the text area in the image quality prioritized general document mode and in the photo mode (the image quality prioritized mode) is switched from the diffusion dither method to the line dither method. Further, in the high-resolution mode, the number of the lines per inch utilized for the photo area is switched from 250 lpi to 200 lpi and the number of the lines per inch utilized for the text area is switched from 600 lpi to 300 lpi. As a result, the target fixing temperatures for the energy saving prioritized mode are changed from the temperatures shown in corresponding portions in FIG. 7 to the temperatures shown in FIG. 20 (the portions surrounded by the double frames in FIG. 20 are the changed portions).

As described, in the energy saving prioritized mode, when both the type of the dither method and the number of the lines per inch are changed, the target fixing temperatures can be lowered for broader cases, compared to the case in which only one of them are changed. Therefore, further energy saving effect can be expected.

The target fixing temperatures shown in FIGS. 18-20 are for exemplifying purpose only, and the target fixing temperatures can be arbitrary defined, based on, for example, a configuration of an image forming device, or requirements on image quality and energy efficiency.

Figure 21:
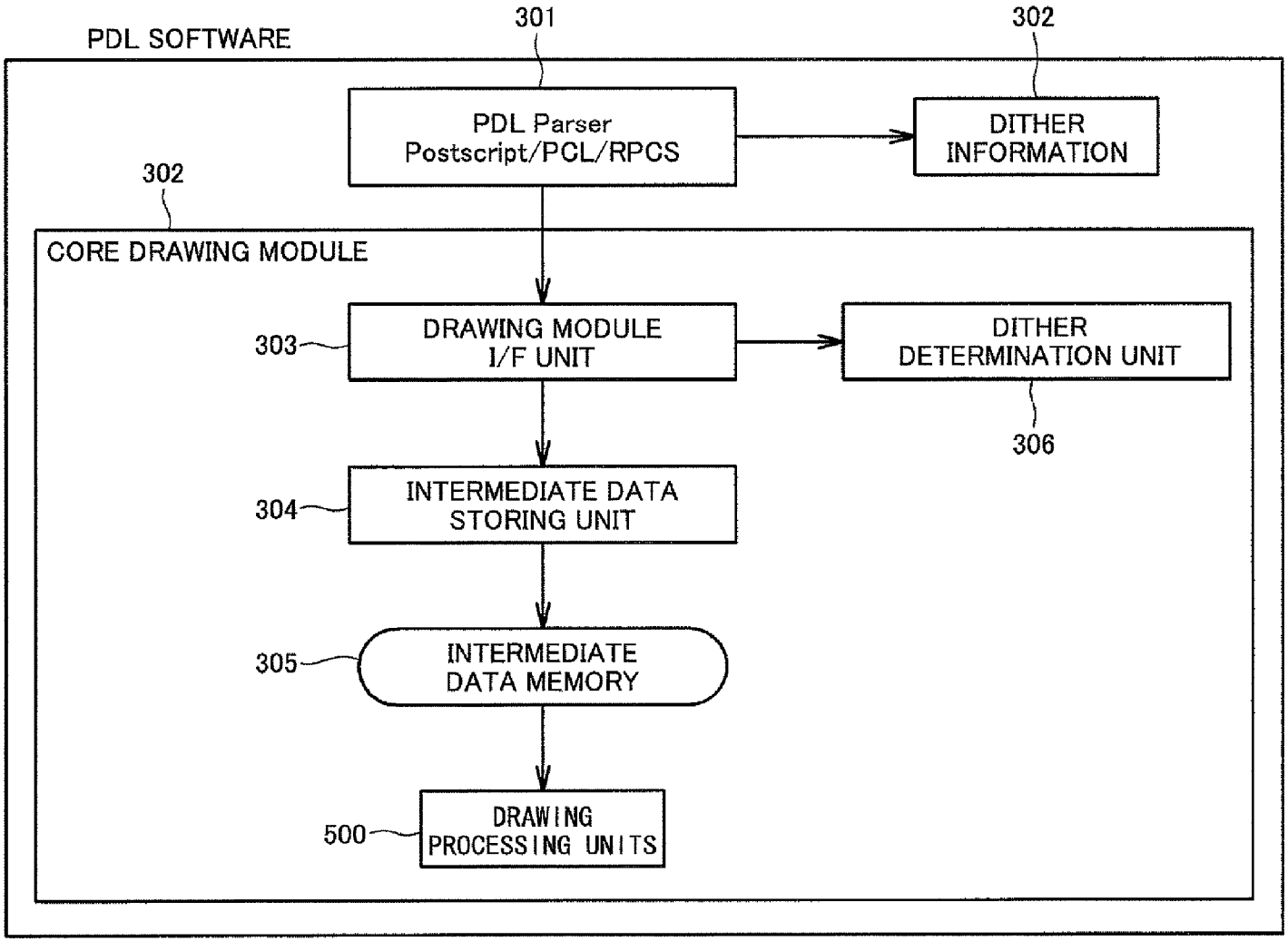
FIG. 21 is a diagram illustrating page description language (PDL) software.

Hereinafter, a method of determining a type of the dither method according to an embodiment is explained. FIG. 21 is a diagram illustrating a configuration of PDL software. The PDL software includes a PDL parser module 301 for parsing each type of the PDL, such as PS, PCL, or RPCS of Ricoh Company, Ltd., and a core drawing module 302 for forming a PDL image. The core drawing module 302 includes a drawing module I/F unit 303, an intermediate data storing unit 304, a destination memory 305, and plural drawing processing units 500. The drawing module I/F unit 303 is an interface for receiving text, an image, a vector graphic, and drawing configuration information. The intermediate data storing unit 304 is for storing the configuration information including drawing data, such as the text, the image, and the vector graphic, and the drawing configuration information including, for example, color configuration information and transparency configuration information. The plural drawing processing units 500 perform rendering to produce output image data, based on the drawing data. Upon activation of the PDL software, the PDL parser module 301 retrieves information about the dither method to be utilized from an environment, such as a ROM area, and provides the retrieved information to the drawing core module 302.

Here, a method of controlling the fixing temperature for a page is explained. A basic unit of print data transmitted from a driver on a host PC to a controller is a job. A single job includes at least one page. One page includes one or more bands. A job includes a drawing command and configuration information. Examples of the drawing command include text, a graphic, and an image. Further, a command for setting a color for drawing and a command for setting a resolution of a page are also included in a job. After receiving the print data, the PDL parser module 301 divides the received print data into, for example, commands for drawing, and transmits the divided print data to the drawing module I/F unit 303. A dither determination unit 306 receives information from the drawing module I/F unit 303. The dither determination unit 306 selects an ID of the dither method to be utilized for the page from the information about types of the dither methods utilized in the environment, based on the depth of the resolution of the page and other settings. Here, the dither determination unit 306 has received the information about types of the dither method utilized in the environment, in advance. Subsequently, the drawing color is set. When a drawing command I/F in the drawing module I/F unit 303 is called, an image plane and a density value are determined for the dither method utilized at the coordinates of the drawing destination specified in the drawing command. The dither determination unit 306 may be included in the drawing module I/F unit 303. When the dither ID, the image plane, and the density value are determined, the fixing temperature information is determined. Thus, the fixing temperature information for the drawing command is obtained.

Figure 22:
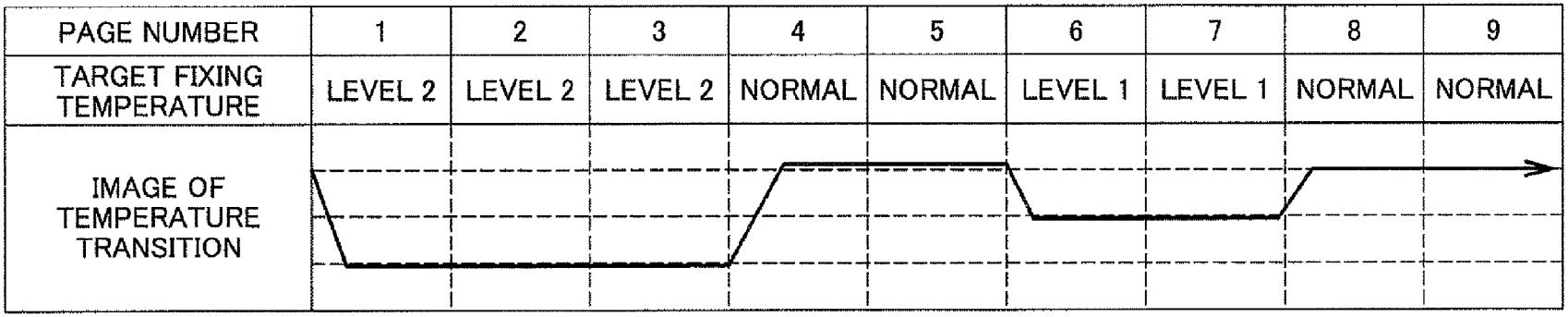
FIG. 22 is a diagram showing an example of transition of the fixing temperature during continuous printing in the embodiment.

FIG. 22 is a diagram showing transition of the fixing temperature during continuous printing, according to an embodiment. As described above, in each of the embodiments of the present invention, the fixing temperature is selected for each sheet of the recording media P, when plural sheets of the recording media P are continuously printed. Therefore, it is possible that the fixing temperature shifts among the normal temperature, the level 1 temperature, the level 2 temperature, and the level 3 temperature, during the continuous printing. The example of FIG. 22 shows the target fixing temperatures (the normal temperature, level 1 temperature, and level 2 temperature) for the first page through the ninth page, which are continuously printed, and a transition image of the fixing temperature. Here, the fixing temperature is shifted in accordance of the change of the target fixing temperature. In FIG. 22, an amount of the increment of the fixing temperature is especially large between the third page and the fourth page. Here, the fixing temperature increases from the level 2 temperature to the normal temperature. Therefore, it may be necessary to rapidly increase the fixing temperature. However, when the number of continuously fed sheets per unit time is large (for example, the number of sheets that can be fed in one minute (CPM)), it is possible that a failure, such as a cold offset, occurs, because the time interval between two successive sheets during the continuous feeding is too short for the fixing temperature to follow the target fixing temperature. Therefore, in order to prevent such a failure, in the embodiment, the fixing temperature is controlled as follows, during continuous printing.

Figure 23:
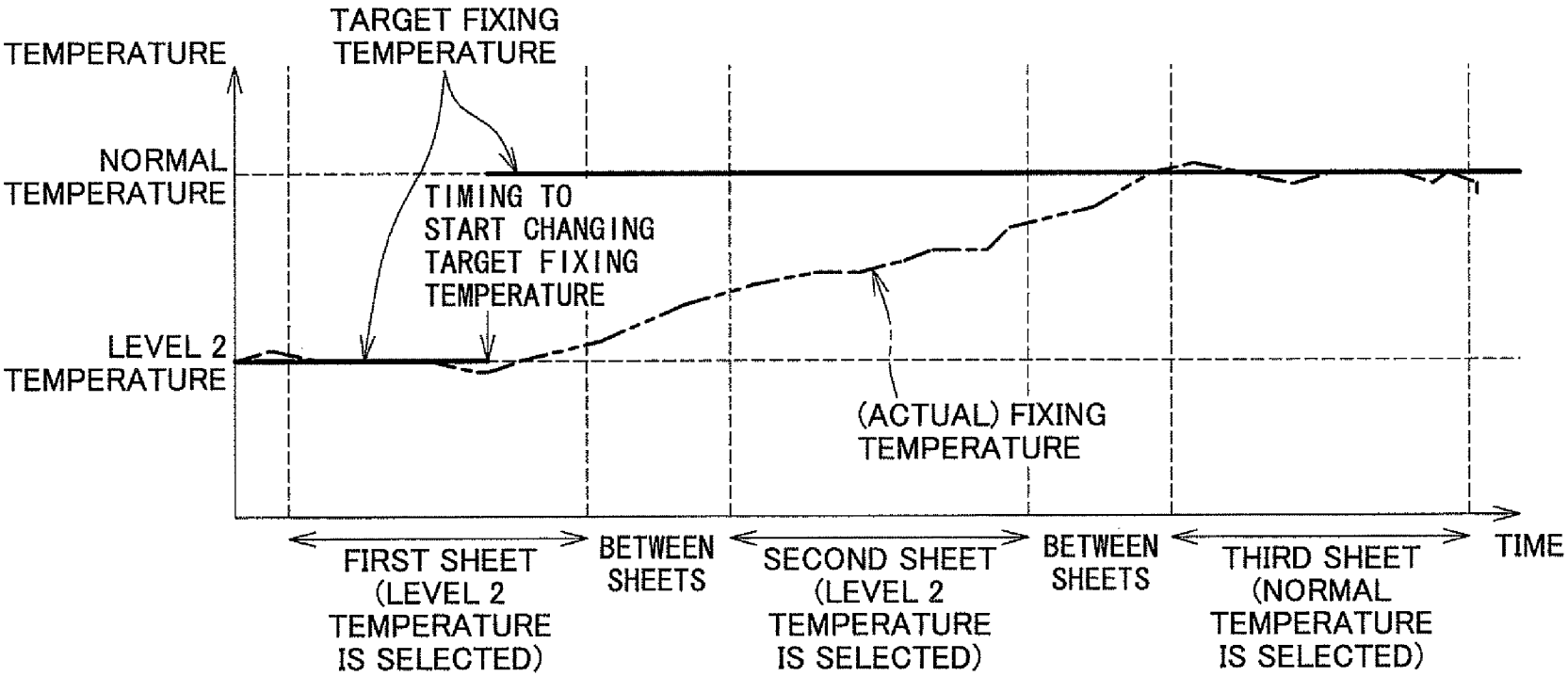
FIG. 23 is a diagram illustrating a timing to start changing the target fixing temperature in the embodiment.

FIG. 23 shows transition of the (actual) fixing temperature for an example case in which three sheets of paper are fed. In FIG. 23, the vertical axis represents temperature and the horizontal axis represents time. In FIG. 23, the long dashed double-short dashed line shows the (actual) fixing temperature, and the solid line shows the target fixing temperature. In this case, since the target fixing temperatures selected for the first sheet and the second sheet are the level 2 temperature, it is not necessary to change the target fixing temperature between the first sheet and the second sheet. However, since the target fixing temperature selected for the third sheet is the normal temperature, it may be required to significantly increase the fixing temperature between the second sheet and the third sheet. In the embodiment, when the fixing temperature is significantly increased between the second sheet and the third sheet, the timing to start changing the target fixing temperature from the level 2 temperature to the normal temperature is set to be a timing prior to the completion of the passage of the second sheet through the fixing device (the fixing nip). In this manner, it is possible to start raising the (actual) fixing temperature at an earlier timing, by setting the timing to start changing the target fixing temperature to be the timing prior to the completion of the passage of the second sheet, not to be the timing after the completion of the passage of the second sheet. Therefore, the fixing temperature can be raised to the normal temperature, which has been the target temperature, by the time at which the third sheet starts passing through the fixing device.

To be more specific, the timing to start changing the target fixing temperature from the level 2 temperature to the normal temperature is set to be a timing at which the first image forming unit (in FIG. 1, the process unit 1Y for yellow) among the plural image forming units starts image forming operations on the second sheet of the recording media P. With this, when the second sheet is fed to the fixing device, the surface temperature of the fixing roller, which is the fixing member, starts to be raised from the level 2 temperature to the normal temperature. The surface temperature of the fixing roller reaches the normal temperature, prior to the third sheet of the recording medium P passing through the fixing nip.

Figure 24:
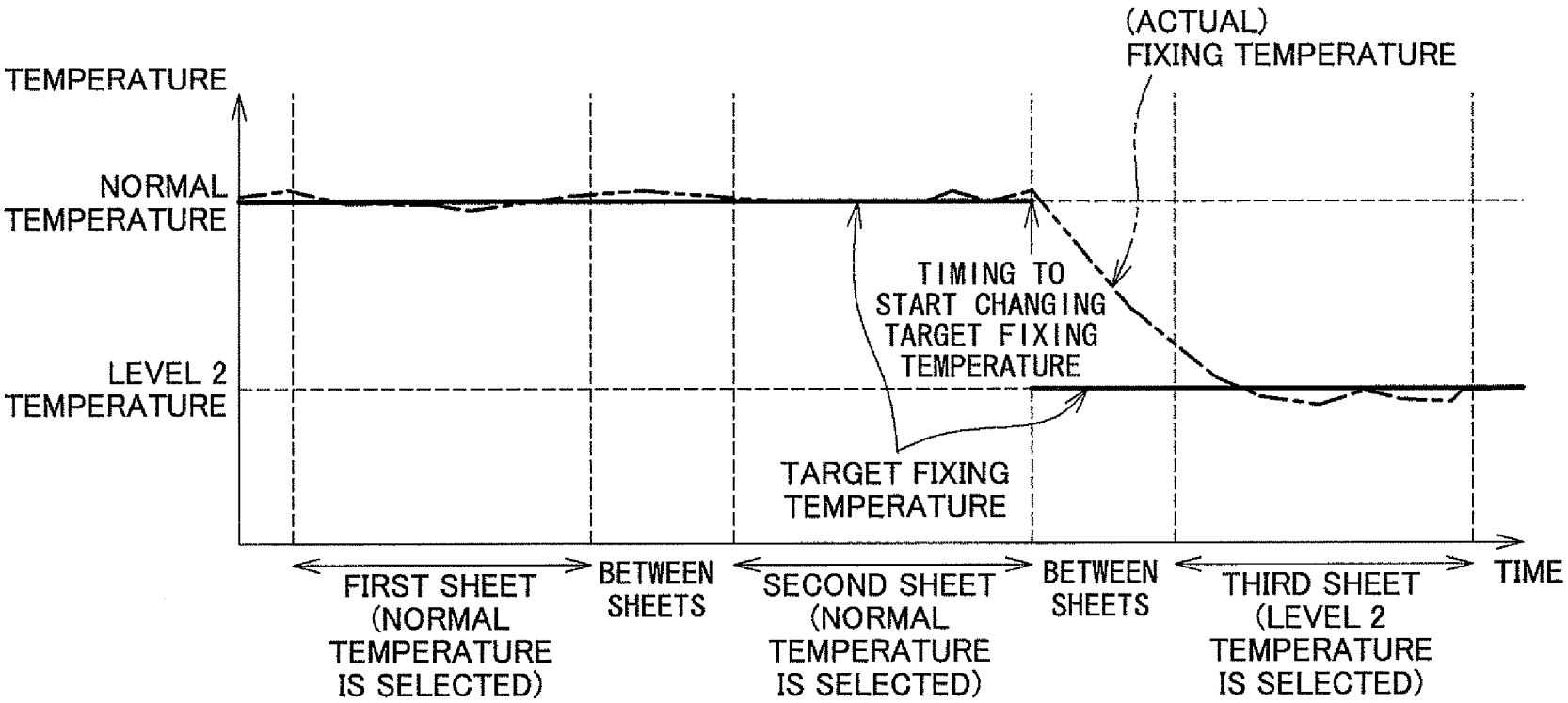
FIG. 24 is a diagram illustrating a timing to start changing the target fixing temperature in the embodiment.

Unlike the case of FIG. 23, FIG. 24 shows transition of the (actual) fixing temperature under a condition such that the first and second sheets are output at the normal temperature, and the third sheet is output at the level 2 temperature. In FIG.

24, also the long dashed double-short dashed line shows the (actual) fixing temperature, and the solid line shows the target fixing temperature. In this case, it may be required to change the target fixing temperature from the normal temperature to the level 2 temperature, between the second sheet and the third sheet. Here, the timing to start changing the target fixing temperature is set to be a timing which is immediately after the completion of the passage of the second sheet through the fixing device (the fixing nip). The fixing temperature is not completely lowered to the level 2 temperature, at the timing to start feeding the third sheet to the fixing nip. However, a failure does not occur, even if the fixing temperature is not completely lowered to the level 2 temperature, which has been the target temperature.

As described above, when the target fixing temperature for the second sheet of the recording media P, which is processed after the first sheet of the recording media has been processed, is higher than the target fixing temperature for the first sheet of the recording media P (e.g., the case shown in FIG. 23), the timing to start changing the target fixing temperature is set to be an earlier timing, compared to that of the case in which the target temperature for the second sheet is lower than the target fixing temperature for the first sheet (e.g., the case shown in FIG. 24). In this manner, the fixing temperature for each sheet of the recording media P can be set to a desired temperature during continuous printing, even if the number of the sheets continuously fed per unit time is large. With this, an occurrence of a failure, such as cold offset, can be prevented. Further, since it is not necessary to provide a time for waiting for the fixing temperature to be sufficiently raised, the fixing temperature can be changed without lowering the productivity (printing speed).

Further, when the target fixing temperature for the second sheet of the recording media P, which is processed after the first sheet of the recording media P has been processed, is higher than the target fixing temperature for the first sheet of the recording media P, the timing to start changing the target fixing temperature may be set to be a much earlier timing, as the difference between the target temperatures becomes greater. For example, when the target fixing temperature is changed between the second sheet and the third sheet, the difference between the target temperatures is greater for the case in which the target fixing temperature is changed from the level 2 temperature to the normal temperature, compared to that of the case in which the target fixing temperature is changed from the level 1 temperature to the normal temperature. Therefore, if the difference between the target fixing temperatures is large, the fixing temperature can be raised in time by starting changing the target fixing temperature at an earlier timing, compared to that of the case in which the difference between the target fixing temperatures is small.

In the examples of FIGS. 23 and 24, the timing to start changing the target fixing temperature is explained for the case in which the target fixing temperature changes between the level 2 temperature and the normal temperature. However, similar to the above described cases, the timing to start changing the target fixing temperature can be shifted for the case in which the target fixing temperature changes between the level 3 temperature and the normal temperature, and for the case in which the target fixing temperature changes between the level 3 temperature and the level 1 temperature.

Figure 25:
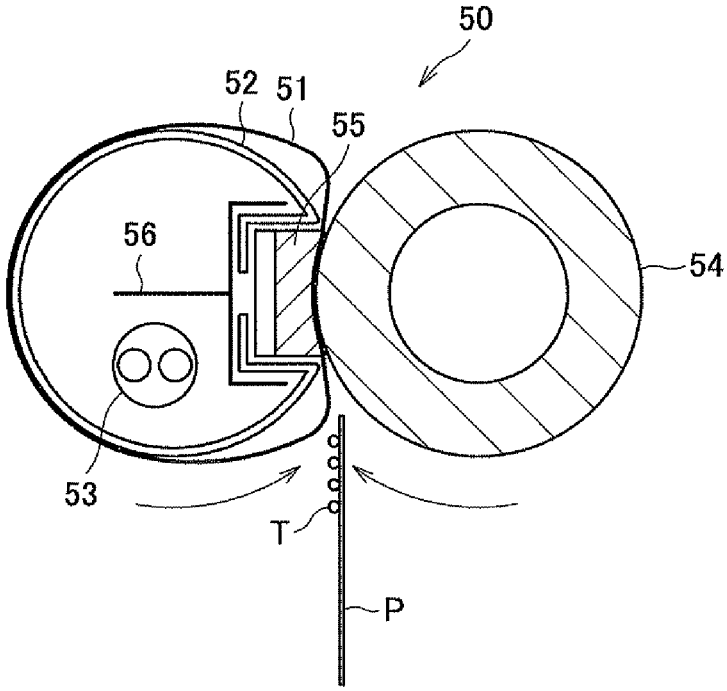
FIG. 25 is a schematic cross-sectional diagram showing another fixing device to which the configuration according to any of the embodiments can be applied.

FIG. 25 is a schematic cross-sectional view showing a configuration of another fixing device to which the embodiments of the present invention can be applied. As shown in FIG. 25, the fixing device 50 includes an endless fixing belt 51, a metal pipe 52, a heater 53, a pressing roller 54, a nip forming member 55, and an auxiliary stay 56. The endless fixing belt 51 is for fixing the image T to be fixed, which is attached to the sheet of the recording medium P, onto the sheet of the recording medium P. The metal pipe 52 is a bearing member for supporting the inner circumferential surface of the fixing belt 51. The heater 53 is a heating member for heating the fixing belt 51. The pressing roller 54 is a pressing member for pressing the fixing belt 51 from an outer circumference side. The nip forming member 55 is disposed at an inner circumference side of the fixing belt 51, and forms a fixing nip by contacting the pressing roller 54 through the fixing belt 51.

The fixing belt 51 includes a substrate formed of, for example, a stainless steel (SUS) or nickel, and a surface layer formed of a silicone rubber covering the substrate and paraformaldehyde (PFA). The metal pipe 52 includes a substrate formed of the SUS or nickel. It is preferable that a fluorine-based slide coating be applied to the outer circumferential surface of the metal pipe 52, which contacts the fixing belt 51. The pressing roller 54 includes a metal core formed of a metal, and an elastic layer formed of a silicone and covering the outer circumferential surface of the metal core. The nip forming member 55 is formed of, for example, fluororubber which is covered by a polytetrafluoroethylene (PTEF) sheet or the like.

The metal pipe 52 is heated by the heater 53. With this, the temperature of the fixing belt 51, which is contacting the metal pipe 52, is raised. Then the image T to be fixed on the sheet of the recording medium P is fixed onto the sheet of the recording medium P, when the sheet of the recording medium P supporting the toner image T to be fixed passes through the fixing nip between the rotating fixing belt 51 and the pressing roller 54, in a state in which the temperature of the fixing belt 51 has reached the target fixing temperature. After the temperature of the fixing belt 51 is lowered through the fixing process, the fixing belt 51 is heated by the heater 53 again. After that, this flow is repeated.

Figure 26:
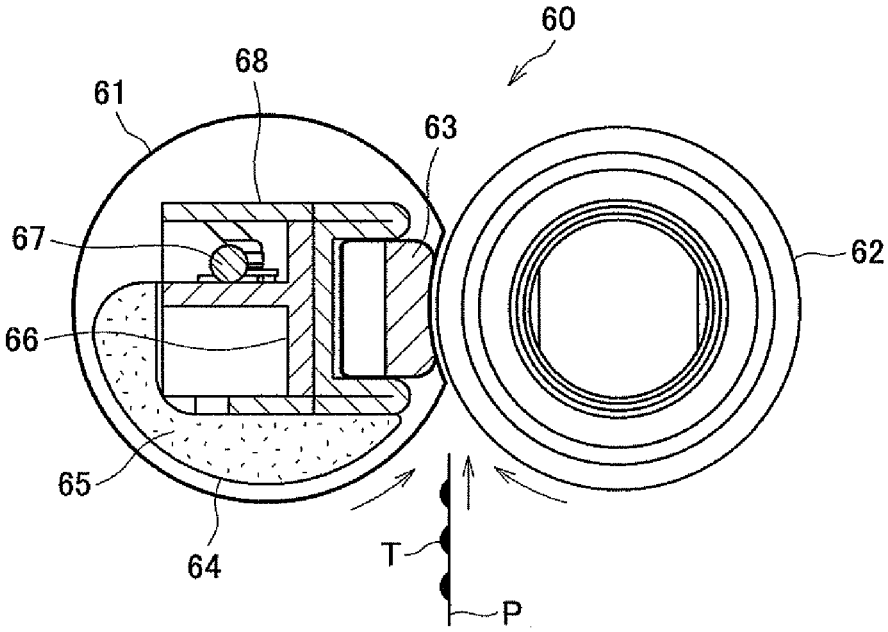
FIG. 26 is a schematic cross-sectional diagram showing another fixing device to which the configuration according to any of the embodiments can be applied.

FIG. 26 is a schematic cross-sectional view showing a configuration of another fixing device to which the embodiments of the present invention can be applied. As shown in FIG. 26, the fixing device 60 includes a fixing sleeve 61 as a fixing member; a pressing roller 62 that is a pressing member for pressing the fixing sleeve 61; a nip forming member 63 that is disposed in an inner circumferential surface side of the fixing belt, and that is for forming a fixing nip by contacting the pressing roller 62 through the fixing belt 61; a planar heating element 64 that is a heating member for heating the fixing belt 61; and a heating element supporting member 65 that supports the planar heating element 64 at a predetermined position. Further, in FIG. 26, the element 66 is a stay for a terminal block, the element 67 is a feeder, and the element 68 is a core supporting member.

The planar heating element 64 is formed by arranging a resistance heating unit inside a flexible film-like member. Further, the planar heating element 64 contacts the inner circumferential surface of the fixing sleeve 61 and thereby directly heats the fixing sleeve 61. Further, the planar heating element 64 may be disposed in the vicinity of the fixing sleeve 61. The image T to be fixed, which has been supported on the sheet of the recording medium P, is fixed onto the sheet of the recording medium P, when the sheet of the recording medium P supporting the image T to be fixed passes through the fixing nip between the rotating fixing sleeve 61 and the pressing roller 62, in a state in which the fixing sleeve has been heated and the temperature of the fixing sleeve 61 has reached the target fixing temperature.

Further, the present invention is not limited to the specifically disclosed embodiments, and variations and modifications may be made without departing from the scope of the present invention. The fixing device to which the embodiments of the present invention can be applied is not limited by the above fixing devices. For example, alternatively to the pressing roller, a pressing member, such as a pressing belt may be utilized, and a heating member for heating the pressing member may be provided. Further, the image forming device according to the embodiments of the present invention is not limited to the color laser printer shown in FIG. 1. The image forming device may be a printer, a copier, a facsimile machine, or a combined machine thereof.

Hereinafter, the low-temperature fixing black toner is explained in detail. The temperature for fixing the low-temperature fixing black toner is at least 10 degrees Celsius lower than the temperature for fixing the color toner. The low-temperature fixing black toner includes at least a thermoplastic resin. The low-temperature fixing black toner includes, as the thermoplastic resin, at least a crystalline polyester resin, a non-crystalline polyester resin, a wax, and a colorant. When the temperature is increased in a differential scanning calorimetry (DCS) experiment, the differential heat curve shows an explicit endothermic peak in a range from 50 to 100 degrees Celsius. The melting point of the crystalline polyester resin is in a range from 60 to 80 degrees in Celsius, and the melting point of the wax is in a range from 70 to 90 degrees in Celsius. When the melting point of the crystalline polyester resin is less than 60 degrees Celsius, the heat-resistant storage stability is lowered, and when the melting point of the crystalline polyester resin is greater than 80 degrees Celsius, the low-temperature fixing property is lowered. When the melting point of the wax is less than 70 degrees Celsius, the heat-resistant storage stability is lowered, and when the melting point of the wax is greater than 90 degrees Celsius, the low-temperature fixing property is lowered. In general, it is preferable, for the low-temperature fixing property, that the melting points of the crystalline polyester and the wax be low temperatures. However, when the melting points of the crystalline polyester and the wax are too low, the heat-resistant storage stability is lowered. Further, since the heat-resistant storage stability of the wax tends to be more degraded compared to that of the crystalline polyester, it is preferable that the melting point of the wax be higher than that of the crystalline polyester.

[Organic Solvent]

It is preferable that an organic solvent has a property such that the organic solvent completely dissolves the crystalline polyester resin and forms a homogeneous solution at a high temperature, and when the homogeneous solution is cooled, the solvent is phase separated from the crystalline polyester and forms an inhomogeneous solution. For example, toluene, ethyl acetate, butyl acetate, methyl ethyl ketone, or methyl isobutyl ketone may be singularly used as the solvent. Alternatively, 2 or more of them may be combined and used as the solvent.

[Effect of Crystalline Polyester Resin]

Since the crystalline polyester resin included in the toner has a high crystallizability, the crystalline polyester resin indicates a hot melt property such that the viscosity of the crystalline polyester resin is rapidly lowered in the neighborhood of the fixing start temperature. Namely, the crystalline polyester resin indicates fine heat-resistant storage stability, due to the crystallizability, in a range of temperatures immediately below the melting start temperature. At the melting start temperature, the viscosity of the crystalline polyester resin is rapidly lowered (sharp melt property) and the crystalline polyester is fixed. Therefore, it is possible to design toner having a fine heat-resistant storage stability and a fine low-temperature fixing property. Further, it turns out that the crystalline polyester resin indicates a fine result on the releasability (the difference between the lower limit of the fixing temperature and the temperature at which a hot offset occurs).

[Crystalline Polyester Resin]

For example, the crystalline polyester resin is synthesized by using a saturated aliphatic diol compound having a carbon number in a range from 2 to 12, as an alcohol component, and at least dicarboxylic acid having a carbon number in a range from 2 to 12 and including a double bond (C═C bond), or saturated dicarboxylic acid having a carbon number in the range from 2 to 12, particularly, fumaric acid, 1,4-butanedioic acid, 1,6-hexanedioic acid, 1,8-octanedioic acid, 1,12-decanedioic acid, or derivatives thereof, as an acid component. Here, examples of the saturated aliphatic diol compound having the carbon number in the range from 2 to 12 include 1,4-butanediol, 1,6-hexanediol, 1,8-octanediol, 1,10-decanediol, 1,12-dodecanediol, and derivatives thereof.

Especially, it is preferable that the crystalline polyester resin be formed of only a saturated aliphatic diol compound having a carbon number in a range from 4 to 12, namely, any of 1,4-butanediol; 1,6-hexanediol; 1,8-octanediol; 1,10-decanediol; and 1,12-dodecanediol, and saturated dicarboxylic acid having a carbon number in a range from 4 to 12, namely, any of 1,4-butanediol; 1,6-hexanediol; 1,8-octanediol; 1,10-decanediol; and 1,12-dodecanediol. That is because, when the crystalline polyester resin is formed of the above elements, the crystalline polyester resin has a high crystallizability, and indicates a rapid change in the viscosity in the neighborhood of the melting point.

Further, as a result of intensive studies for ensuring both the low-temperature fixing property and the heat-resistant storage stability, it has been found that, for the crystalline polyester, both the low-temperature fixing property and the heat-resistant storage stability are ensured, if the melting point of the crystalline polyester is higher than or equal to 60 degrees in Celsius and lower than 80 degrees Celsius. When the melting point of the crystalline polyester is lower than 60 degrees Celsius, the heat-resistant storage stability is degraded, and when the melting point of the crystalline polyester is greater than or equal to 80 degrees Celsius, the low-temperature fixing property is degraded.

Further, as a method of controlling the crystallizability and the melting point of the crystalline polyester resin, a method of designing and utilizing non-linear polyester, to which condensation polymerization is applied, can be considered. Here, the condensation polymerization can be performed by adding polyhydric alcohol having a valence number higher than or equal to 3, such as glycerin, to the alcohol component, and/or by adding polyvalent carboxylic acid having a valence number higher than or equal to 3, such as trimellitic anhydride, to the acid component.

A molecular structure of the crystalline polyester can be observed by, in addition to the NMR measurement using a solution or a solid, the X-ray diffraction, the gas chromatography-mass spectrometry (GS-MS), the liquid chromatography-mass spectrometry (LC-MS), and the IR measurement. However, as a simple example of the molecular structure of the crystalline polyester, a molecular structure can be considered such that its infrared absorption spectrum includes an absorption spectrum at 965±10 $cm^{-1}$ or at 990±10 $cm^{-1}$, which is based on the out-of plane bending vibration (δCH) of olefin.

As a result of intensive studies from a viewpoint that, for the molecular weight of the crystalline polyester, a crystalline polyester having a sharp molecular distribution and having low molecular weight has a fine low-temperature fixing property, and that the heat-resistant storage stability is degraded for a crystalline polyester including many components having low molecular weights, it has been found that the low-temperature fixing property and the heat-resistant storage stability are ensured at the same time, if the weight-average molecular weight of the elements of the crystalline polyester is greater than or equal to 5,000 and less than or equal to 20,000, if the ratio of the elements of the crystalline polyester having the number average molecular weight that is less than or equal to 500 is greater than or equal to 0% and less than or equal to 5.0%, and if the ratio of the crystalline polyester having molecular weight less than or equal to 1000 is greater than or equal to 0% and less than or equal to 5.0%, based on the molecular weight distribution of elements of the crystalline polyester that are soluble to o-dichlorobenzene obtained by the gel permeation chromatography (GPC). Further, it is preferable that the ratio of the elements of the crystalline polyester having the number average molecular weight that is less than or equal to 500 be greater than or equal to 0% and less than or equal to 2.0%, and that the ratio of the crystalline polyester having molecular weight less than or equal to 1000 be greater than or equal to 0% and less than or equal to 4.0%.

It is preferable that an acid value A and a hydroxyl value B of the crystalline polyester resin satisfy the following relational expressions.

$$10 \text{ mg KOH/g} < A < 40 \text{ mg KOH/g}$$

$$0 \text{ mg KOH/g} < B < 20 \text{ mg KOH/g}$$

$$20 \text{ mg KOH/g} < A+B < 40 \text{ mg KOH/g}$$

When the acid value is less than or equal to 10 mg KOH/g, the affinity of the crystalline polyester resin with respect to the paper, which is the recording medium P, may be degraded, and the heat-resistant storage stability may be degraded. Further, when the acid value is greater than or equal to 40 mg KOH/g, or when the hydroxyl value is less than or equal to 20 mg KOH/g, it is possible that the charging ability of the toner under high temperature and high humidity is lowered. Further, when the total of the acid value and the hydroxyl value is less than or equal to 20 mg KOH/g, it is possible that the compatibility of the crystalline polyester resin with the non-crystalline polyester is lowered and the low-temperature fixing property becomes insufficient. Further, when the total of the acid value and the hydroxyl value is greater than or equal to 40 mg KOH/g, since the compatibility of the crystalline polyester resin with the non-crystalline polyester is too enhanced, it is possible that the heat-resistant storage stability is lowered.

It is preferable that the solubility of the crystalline polyester with respect to the organic solvent at 70 degrees Celsius is 10 parts by mass or more. When the solubility is less than 10 parts by mass, since the affinity between the organic solvent and the crystalline polyester is insufficient, it is difficult to disperse the crystalline polyester in the organic solvent, so that particles of the crystalline polyester have sub-micron size. Thus, the crystalline polyester existing in the toner becomes uneven, and it is possible that the charging ability is lowered, and the image quality in long-term use is degraded.

It is preferable that solubility of the crystalline polyester with respect to the organic solvent at 20 degrees Celsius be less than 3.0 parts by mass. When the solubility is greater than or equal to 3.0 parts by mass, the crystalline polyester dissolved in the organic solvent tends to become compatible with the non-crystalline polyester. Thus it is possible that the heat-resistant storage stability is lowered, the developing unit becomes unclean, and the image quality is degraded.

It is preferable that the crystalline polyester resin include a binder resin precursor as a binder resin component. Further, as the toner, the toner that can be obtained by the following procedure is preferable. Namely, compounds that are elongated by the binder resin precursor or cross-linked with the binder resin are dissolved into an oil phase that is obtained by dissolving and/or dispersing the binder resin precursor including, at least, a colorant, a releasing agent, a crystalline polyester resin, binder resin precursor formed of modified polyester resin, and binder resin precursor other than the binder resin precursor formed of the modified polyester resin into an organic solvent. Subsequently, the resultant oil phase is dispersed into an aqueous solvent including a particular dispersant, and an emulsified dispersant is obtained. Then, the binder resin precursor is cross-link reacted and/or elongation reacted in the emulsified dispersant, and the toner is obtained by removing the organic solvent.

[Binding Resin Precursor]

As the binding resin precursor, the binding resin precursor formed of the modified polyester resin is preferable. Examples of the modified polyester resin include polyester prepolymer modified with isocyanate or epoxy. Such polyester prepolymer elongation reacts with a compound having an active hydrogen group (such as amine), and improves the releasability (the difference between the lower limit of the fixing temperature and the temperature at which a hot offset occurs). The polyester prepolymer can be synthesized by reacting a polyester resin, which is a base, with an isocyanating agent or an epoxidation agent. Here, the isocyanating agent and the epoxidation agent have conventionally been known. Examples of the isocyanating agent include aliphatic polyisocyanates (e.g., tetramethylene diisocyanate, hexamethylene diisocyanate, 2,6-diisocyanatomethyl caproate); alicyclic polyisocyanates (e.g., isophorone diisocyanate, cyclohexylmethane diisocyanate); aromatic diisocyanate (e.g., tolylene diisocyanate, diphenylmethane diisocyanate); aromatic aliphatic diisocyanates (e.g., α,α,α',α'-tetramethylxylylene diisocyanate); isocyanurates; and the polyisocyanates blocked with phenol derivative, oxime, caprolactam; and a combination of two or more of these compounds. Further, as an example of the epoxidation agent, epichlorohydrin can be considered.

The ratio of the isocyanating agent, which is an equivalence ratio [NCO]/[OH] between the isocianate group [NCO] and the hydroxyl groups [OH], is usually in a range from 5/1 to 1/1. It is preferable that the ratio of the isocyanating agent be in a range from 4/1 to 1.2/1. Further, it is more preferable that the ratio of the isocyanating agent be in a range from 2.5/1 to 1.5/1. When the [NCO]/[OH] exceeds 5, the low-temperature fixing property is lowered. When the molar ratio of [NCO] is less than 1, urea content of the polyester prepolymer is lowered, and the hot offset resistance is lowered.

The content of the isocyanating agent included in the polyester prepolymer is usually in a range from 0.5 to 40% by mass. It is preferable that the content be in a range from 1 to 30% by mass. Further, it is more preferable that the content be in a range from 2 to 20% by mass. When the content is less than 0.5% by mass, the hot offset resistance is lowered, and it is disadvantageous in the aspect of ensuring both the heat-resistant storage stability and the low-temperature fixing property. Further, when the content exceeds 40% by mass, the low-temperature fixing property is lowered.

Further, the number of the isocyanate groups included in one molecule of the polyester prepolymer is usually greater than 1. It is preferable that the average number of the isocyanate groups included in one molecule of the polyester prepolymer be in a range from 1.5 to 3. Further, it is more preferable that the average number be in a range from 1.8 to 2.5. When the number of the isocyanate groups included in one molecule of the polyester prepolymer is less than 1, the molecular weight of the urea modified polyester resin after the elongation reaction is lowered, and the hot offset resistance is lowered. It is preferable that weight average molecular weight of the binder resin precursor be in a range from $1\times10^4$ to $3\times10^5$.

[Compound Cross-Linking Reacts or Elongation Reacts with Binder Resin Precursor]

The examples of the compound that elongation reacts or cross-linking reacts with the binder resin precursor include compounds having active hydrogen groups. Specifically, amins can be considered as the examples. Examples of the amins include diamine compounds, polyamine compounds having a valence greater than or equal to 3, amino alcohol compounds, amino mercaptan compounds, amino acid compounds, and compounds in which these amino groups are blocked. Examples of the diamine compounds include aromatic diamines (such as phenylenediamine, diethyltoluenediamine, 4,4'-diaminophyenylmethane); alicyclic diamines (such as 4,4'-diamino-3,3'-dimethyldicyclohexylmethane, diamine cyclohexane, isophoronediamine); and aliphatic diamines (such as ethylenediamine, tetramethylenediamine, hexamethylenediamine). Examples of the polyamine compounds having the valence greater than 3 include diethylenetriamine and triethylenetetramine. As examples of the amono alcohol compounds, ethanolamine and hydroxyethylaniline can be considered. As examples of the amino mercaptan compounds, aminoethyl mercaptan and aminopropyl mercaptan can be considered.

As examples of the amino acid compounds, aminopropionic acid and aminocaproic acid can be considered. Examples of the compounds in which these amino groups are blocked include ketimine compounds and oxazoline compounds obtained from the amines and ketones (such as acetone, methyl ethyl ketone, methyl isobutyl ketone). Among these amines, diamine compounds and a mixture of the diamine compounds and a small amount of a polyamine compounds are preferable.

[Colorant]

As a colorant, all the dyes and pigments which have conventionally been known can be utilized. Examples of usable colorants include carbon black, nigrosine dyes, iron black, naphtol yellow S, hansa yellow (10G, 5G, and G), cadmium yellow, yellow iron oxide, yellow ochre, chrome yellow, titan yellow, polyazo yellow, oil yellow, hansa yellow (GR, A, RN, and R), pigment yellow L, benzidine yellow (G and GR), permanent yellow (NCG), vulcan fast yellow (5G and R), tartrazine lake, quinoline yellow lake, anthrazane yellow BGL, isoindolinone yellow, red oxide, read lead, vermilion lead, cadmium red, cadmium mercury red, antimony vermilion, permanent red 4R, para red, fire red, para chloro-o-nitoroaniline red, lithol fast scarlet G, brilliant fast scarlet, brilliant carmine BS, permanent red (F2R, F4R, FRL, FRLL, and F4RH), fast scarlet VD, vulcan fast rubine B, brilliant scarlet G, lithol rubine GX, permanent red F5R, brilliant carmine 6B, pigment scarlet 3B, bordeaux 5B, toluidine maroon, permanent bordeaux F2K, helio bordeaux BL, bordeaux 10B, bon maroon light, bon maroon medium, eosin lake, rhodamine lake B, rhodamine lake Y, alizarine lake, thioindigo red B, thioindigo maroon, oil red, quinacridone red, pyrazolone red, polyazo red, chrome vermilion, benzidine orange, perynone orange, oil orange, cobalt blue, cerulean blue, alkali blue lake, peacock blue lake, victoria blue lake, metal-free phthalocyanine blue, phthalocyanine blue, fast sky blue, indanthrene blue (RS and BS), indigo, ultramarine, navy blue, anthraquinone blue, fast violet B, methyl violet lake, cobalt violet, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquionone green, titanium oxide, zinc oxide, lighopone, and a mixture of any of these. The content of the colorant is usually in a range from 1 to 15% by mass with respect to the toner. It is preferable that the content be in a range from 3 to 10% by mass.

The colorant can utilized as a master batch combined with a resin. Examples of a binder resin that is utilized to produce the master batch or that is kneaded with the master batch includes styrene and a polymer of its substitution product, such as polystyrene, poly-p-chlorostyrene, polyvinyl toluene, in addition to the modified polyester resin and a polyester resin to be modified; a styrene copolymer, such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl $\alpha$-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer; polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic acid, rosin, modified rosin, terpene resin, aliphatic or alicyclic hydrocarbon resin, aromatic petroleum resin, chlorinated paraffin, and paraffin wax. These can be independently used. Alternatively, any of these can be combined and used.

The master batch can be obtained by mixing and kneading the resin for the master batch and the colorant while applying a high shear force. In this case, an organic solvent can be utilized to increase the interaction between the colorant and the resin. Further, a flushing method is favorably utilized, since a wet cake of a colorant can be used as it is without drying. Here, the flushing method is a method of removing water and an organic solvent such that an aqueous paste including a colorant and the water is mixed and kneaded with a resin and the organic solvent, and thereby the colorant is transferred to the side of the resin. For the mixing and kneading, a high shear dispersing device, such as three roll mills, is preferably used.

[Release Agent]

It is preferable that the release agent be a wax having a melting point in a range from 50 to 120 degrees Celsius. Since such a wax effectively acts as a release agent between the fixing roller and a boundary surface of the toner, a high temperature offset property can be improved without applying a release agent, such as oil, to the fixing roller.

Here, the melting point of the wax can be obtained by measuring the maximum endothermic peak using a differential scanning calorimeter such as TG-DCS system TAS-100 (manufactured by Rigaku Corporation). The following materials can be used as the release agent.

Namely, examples of the waxes include plant waxes, such as carnauba wax, cotton wax, sumac wax, and rice wax; animal waxes, such as bee wax, and lanoline; mineral waxes, such as ozokerite and ceresin; and petroleum waxes, such as paraffin, microcrystalline, and petrolatum. Besides the above described natural waxes, examples of the waxes include synthetic hydrocarbon waxes, such as Fischer-Tropsch wax and polyethylene wax; and synthetic waxes, such as ester, ketone, and ether.

Additionally, fatty acid amides, such as 1,2-hydroxystearic acid amide, stearic acid amide, phthalic anhydride imide, chlorinated hydrocarbon; and crystalline polymers having a long chain alkyl group at the side chain and having low molecular weight, such as homopolymers or copolymers of polyacrylate, for example, n-stearyl polymethacrylate, n-lauryl polymethacrylate (e.g., copolymer of n-stearyl acrylate-ethyl methacrylate) can be utilized as the release agent.

[Charge Control Agent]

The toner may include a charge control agent. Here, all the conventionally known charge control agents may be used. Examples of the charge control agents include nigrosine dyes, triphenylmethane dyes, metal complex dyes including chromium, chelate pigments of molybdic acid, rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives.

Specifically, examples of the charge control agent include BONTRON 03 (nigrosin dyes), BONTRON P-51 (quaternary ammonium salt), BONTRON S-34 (metal containing azo dye), E-82 (metal complex of oxynaphthoic acid), E-84 (metal complex of salicylic acid), and E-89 (phenolic condensation product), which are produced by Orient Chemical Industries Co., Ltd.; TP-302 and TP-415 (molybdenum complex of quaternary ammonium salt), which are produced by Hodogaya Chemical Co., Ltd; Copy Charge PSY VP2038 (quaternary ammonium salt), Copy Blue PR (triphenyl methane derivative), Copy Charge NEG VP2036 and Copy Charge NX VP434 (quaternary ammonium salt), which are produced by Hoechst AG; LRA-901, and LR-147 (boron complex), which are produced by Japan Carlit Co., Ltd.; copper phthalocyanine; perylene; quinacridone; azo pigments; and macromolecular compounds having a functional group, such as a sulfonate group, a carboxyl group, and a quaternary ammonium group.

The amount of the charge control agent to be utilized is determined based on a type of the binder resin, presence or absence of an additive agent to be utilized, and a producing method of the toner including a dispersing method. The amount is not determined unambiguously. However, it is preferable that the amount of the charge control agent to be utilized be in a range from 0.1 to 10 parts by mass with respect to 100 parts by mass of the binder resin. It is more preferable that the amount of the charge control agent to be utilized be in a range from 0.2 to 5 parts by mass. When the amount of the charge control agent to be utilized exceeds 10 parts by mass, since the electrification property of the toner is too strong, the effect of the main charge control agent is lowered, and an electrostatic attraction force between the toner and the developing roller increases. Therefore, it is possible that the flowability of the developer is lowered and the density of the image is lowered. The charge control agent may be dissolved and dispersed, after it is melted and kneaded with the master batch and the resin. Alternatively, the charge control agent may be directly dissolved into an organic solvent and added when the master batch and the resin are dispersed. In addition, the charge control agent may be fixed on the surfaces of the toner powders, after the toner powders have been produced.

[Non-Crystalline Polyester Resin]

A non-crystalline polyester resin to be modified is utilized as the binder resin component. It is preferable that at least a portion of the modified polyester resin obtained by causing the binder resin precursor to be cross-linking reacted and/or elongation reacted and the polyester resin to be modified is compatibilized. With this, the low-temperature fixing property and the hot offset resistance can be improved. Therefore, it is preferable that the polyol and the polycarboxylic acid included in the modified polyester resin and those of the polyester resin to be modified have similar compositions. Further, non-crystalline polyester resin, which is utilized for a crystalline polyester dispersing liquid, may be utilized as the polyester resin to be modified, provided that the non-crystalline polyester resin has not been modified yet.

It is preferable that the acid value A of the crystalline polyester and the acid value C of the polyester resin to be modified satisfy the following inequality.

$$-10 \text{ mg KOH/g} < A - C < 10 \text{ mg KOH/g}$$

When the differences between the acid values and the hydroxyl values of the crystalline polyester and the non-crystalline polyester, respectively, are greater than 10, since the compatibility and the affinity between the crystalline polyester and the non-crystalline polyester are insufficient, it is possible that the low-temperature fixing property is insufficient. Further, since the crystalline polyester tends to be exposed on the surfaces of the toner particles, it is possible that the developing unit tends to become unclean, and toner filming tends to occur.

Further, the urea modified polyester resin can be used together with a polyester resin that is modified by a chemical bond other than the urea bond, such as a polyester resin modified by a urethane bond, besides the polyester resin to be modified. When the components of the toner include the modified polyester resin, such as the urea modified polyester resin, the modified polyester resin can be produced through a process, such as the one-shot process.

Hereinafter, a producing method of the urea modified polyester resin is explained as an example. First, a polyester resin having hydroxyl groups is prepared by heating polyol and polycarboxylic acid at a temperature in a range from 150 to 280 degrees Celsius in the presence of a catalyst, such as tetrabutoxy titanate or dibutyltin oxide, and by removing generated water while reducing the pressure, if necessary. Subsequently, the polyester resin having the hydroxyl groups is reacted with polyisocyanate at a temperature in a range from 40 to 140 degrees Celsius, thereby obtaining polyester prepolymer having isocyanate groups. Additionally, the polyester prepolymer having the isocyanate groups is reacted with amines at a temperature in a range from 0 to 140 degrees Celsius, thereby obtaining the urea modified polyester resin. The number average molecular weight of the urea modified polyester resin is usually in a range from 1000 to 10000. It is preferable that the number average molecular weight of the urea modified polyester resin is in a range from 1500 to 6000.

Here, when the polyester resin having the hydroxyl groups is reacted with polyisocyanate, and when the polyester prepolymer having the isocyanate groups is reacted with amines, a solvent may be utilized, if necessary. The examples of the solvent include aromatic solvents (e.g., toluene, xylene); ketones (e.g., acetone, methyl ethyl ketone, methyl isobutyl ketone); esters (e.g., ethyl acetate), amides (e.g., dimethylformamide, dimethylacetamide); and ethers (e.g., tetrahydrofuran), which are inactive with the isocyanate group. Additionally, when the polyester resin to be modified is used together, the polyester resin to be modified which is produced in a similar manner to the case of the polyester resin having the hydroxyl groups may be mixed in the solution in which the urea modified polyester resin has been reacted.

As the components of the binder resin included in the oil phase, the crystalline polyester resin, the non-crystalline polyester resin, the binder resin precursor, and the polyester resin to be modified can be used together. Further, the components of the binder resin may include components of the binder resin other than the above resins. It is preferable that polyester resin be included as the component of the binder resin. It is more preferable that the components of the binder resin include 50% by mass or more of the polyester resin. When the content of the polyester resin is less than 50% by mass, it is possible that the low-temperature fixing property is lowered. It is especially preferable that all the components of the binder resin be polyester resin.

Here, examples of the components of the binder resin other than the polyester resin include polymers of styrene or styrene derivatives, such as polystyrene, poly-p-chlorostyrene, and polyvinyl toluene; styrene-based copolymers, such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleate copolymer; polymethyl methacrylate; polybutyl methacrylate; polyvinyl chloride; polyvinyl acetate; polyethylene; polypropylene; epoxy resin; epoxy polyol resin; polyurethane resin; polyamide resin; polyvinyl butyral; polyacrylic resin; rosin; modified rosin; terpene resin; aliphatic or alicyclic hydrocarbon resin; aromatic petroleum resin; chlorinated paraffin; and paraffin wax.

[Production Method of Toner in Aqueous Medium]

The aqueous medium may be water alone. Alternatively, the aqueous medium may be a mixture of water and a solvent that can be mixed with the water. Examples of the solvent that can be mixed with the water include alcohols (e.g., methanol, isopropanol, ethylene glycol), dimethylformamide, tetrahydrofuran, cellosolves (e.g., methyl cellosolve), and lower ketones (e.g., acetone, methyl ethyl ketone).

The components of the toner particle, such as the binder resin precursor, the colorant, the release agent, the crystalline polyester dispersing liquid, the charge control agent, and the polyester resin to be modified, may be mixed, at a time in which dispersing elements are formed in the aqueous medium. However, it is more preferable that these components of the toner be mixed in advance, and subsequently, the resultant mixture be added to the aqueous medium and dispersed. Further, it is not always necessary to mix other toner materials, such the colorant, the release agent, and the charge control agent, at a time in which particles are formed in the aqueous medium. These materials may be added, after the particles have been formed. For example, the colorant may be added by using the known method of dyeing, after the particles not including the colorant have been formed.

A device for dispersing the particles is not particularly limited. For example, known devices, such as a low-speed shearing device, a high-speed shearing device, a frictional device, a high-pressure jet device, and an ultrasonic device, may be utilized. It is preferable to use the high-speed shearing device, so as to regulate the diameters of the dispersed particles in a range from 2 to 20 μm. When the high-speed sharing device is utilized, the speed of the rotation is not particularly limited. However, the speed of the rotation is usually in a range from 1000 to 30000 rpm. It is preferable that the speed of the rotation be in a range from 5000 to 20000 rpm. The time period for dispersing the particles is not particularly limited. However, for the case of the batch method, the time period for dispersing the particles is usually in a range from 0.1 to 60 minutes. A temperature during the time of dispersing the particles is usually in a range from 0 to 80 degrees Celsius (under pressure). It is preferable that the temperature be in a range from 10 to 40 degrees Celsius.

An amount of the aqueous medium that is utilized with respect to 100 parts by mass of the toner components is usually in a range from 100 to 1000 parts by mass. When the amount of the aqueous medium is less than 100 parts by mass, the toner components are not well dispersed, and it is possible that toner particles having a predetermined particle diameter are not obtained. It is not economical to use 1000 parts by mass or more of the aqueous medium. Further, a dispersing agent may be utilized, if necessary. It is preferable to use the dispersing agent, because the particle size distribution becomes sharp, and the particles are stably dispersed.

As a method of causing the polyester prepolymer to react with the compound having the active hydrogen group, the compound having the active hydrogen group may be added to the toner components and reacted, prior to dispersing the toner components in the aqueous medium. Alternatively, the compound having the active hydrogen group may be added to the toner components, after the toner components are dispersed in the aqueous medium, so that the reaction occurs from the boundary surfaces of the particles. In such a case, the polyester modified by the polyester prepolymer is preferentially formed at the surface of the toner particles being produced. Therefore, it is possible to provide a concentration gradient inside the particles.

In order to emulsify and disperse the oil phase, in which the toner components are dispersed, into a solution including water, a dispersant may be utilized. Examples of such a dispersant include anionic surfactants, such as alkylbenzene sulfonate, α-olefin sulfonate, and phosphate; amine salt type dispersant, such as alkylamine salts, amino alcohol fatty acid derivatives, polyamine fatty acid derivatives, and imidazoline; quaternary ammonium salt type cationic surfactants, such as alkyl trimethyl ammonium salts, dialkyl dimethyl ammonium salts, alkyl dimethyl benzyl ammonium salts, pyridinium salts, alkyl isoquinolinium salts, and benzethonium chloride; nonionic surfactants, such as fatty acid amide derivatives and polyol derivatives; and ampholytic surfactants, such as alanine, dodecyl di(aminoethyl)glycine, di(octyl aminoethyl)glycine, and N-alkyl-N,N-dimethyl ammonium betaine.

Further, a surfactant having a fluoroalkyl group is quite effective, even if a small amount of such a surfactant is utilized. Examples of the preferably utilized anionic surfactant having the fluoroalkyl group include fluoroalkyl carboxylic acids having a carbon number in a range from 2 to 10 and metal salts thereof; perfluorooctane sulfonyl glutamic acid disodium; 3-[omega-fluoroalkyl (C6-C11) oxy]-1-alkyl (C3-C4) sulfonic acid sodium; 3-[omega-fluoroalkanoyl (C6-C8)-N-ethylamino]-1-propane sulfonic acid sodium; fluoroalkyl (C11-C20) carboxylic acids and metal salts thereof; perfluoroalkyl (C7-C13) carboxylic acids and metal salts thereof; perfluoroalkyl (C4-C12) sulfonic acids and metal salts thereof; perfluorooctane sulfonic acid dimethanol amide; N-propyl-N-(2-hydroroxyethyl) perfluorooctane sulfonamide; perfluoroalkyl (C6-C10) sulfonamide propyl trimethyl ammonium salts; perfluoroalkyl (C6-C10)-N-ethyl sulfonyl glycine salts; and monoperfluoroalkyl (C6-C16) ethyl phosphates.

Further, examples of a commercially available anionic surfactant having the fluoroalkyl group include SURFLON S-111, S-112, and S-113 (produced by ASAHI GLASS CO., LTD.); FLUORAD FC-93, FC-95, FC-98, and FC-129 (produced by Sumitomo 3M Limited); UNIDYNE DS-101 and DS102 (produced by DAIKIN INDUSTRIES, LTD.); MEGAFACE F-110, F120, F113, F191, F812, and F833 (produced by DIC Corporation); EFTOP EF-102, 103, 104, 105, 112, 123A, 123B, 306A, 501, 201, and 204 (produced by Mitsubishi Materials Electronic Chemicals Co., Ltd.); and FTERGENT F-100 and F-150 (produced by NEOS COMPANY LIMITED).

Further, examples of a cationic surfactant having the fluoroalkyl group include aliphatic primary, secondary, and tertiary amine acids having a fluoroalkyl group; and aliphatic quaternary ammonium salts such as perfluoroalkyl (C6-C10) sulfonamide propyl trimethyl ammonium salts, benzalkonium salts, benzethonium chlorides, pyridinium salts, and imidazolinium salts. Further, examples of a commercially available cationic surfactant having the fluoroalkyl group includes SURFLON S-121 (produced by ASAHI GLASS CO., LTD.); FLUORAD FC-135 (produced by Sumitomo 3M Limited); UNIDYNE DS-202 (produced by DAIKIN INDUSTRIES, LTD.); MEGAFACE F-150 and F-824 (produced by DIC Corporation); EFTOP EF-132 (produced by Mitsubishi Materials Electronic Chemicals Co., Ltd.); and FTERGENT F-300 (produced by NEOS COMPANY LIMITED).

Further, as a dispersing agent that is difficult to be dissolved in water, tricalcium phosphate, calcium carbonate, titanium oxide, colloidal silica, and hydroxyapatite may be utilized. Additionally, dispersion droplets may be stabilized by polymeric colloids or water insoluble organic fine particles. For example, a (metha)acrylic monomer including acids, such as acrylic acid, methacrylic acid, α-cyanoacrylic acid, α-cyanomethacrylic acid, itaconic acid, crotonic acid, fumaric acid, maleic acid, and maleic anhydride or a hydroxyl group; vinyl alcohol or vinyl alcohol ether, such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monomethacrylate, glycerin monomethacrylate, N-methylol acrylamide, and N-methylol methacrylamide; vinyl methyl ether, vinyl ethyl ether, vinyl propyl ether or esters of compounds including vinyl alcohol and a carboxyl group; acrylamide, such as vinyl acetate, vinyl propionate, and vinyl butyrate, methacrylamide, diacetone acrylamide, or methylol compounds thereof; acid chlorides, such as acrylic acid chloride and methacrylic acid chloride; homopolymer or copolymer including nitrogen atoms or a heterocyclic ring of nitrogen atoms, such as vinyl pyridine, vinyl pyrrolidone, vinyl imidazole, and ethlene imine; polyoxyethylenes, such as polyoxyethylene, polyoxypropylene, polyoxyethlene alkyl amine, polyoxypropylene alkyl amide, polyoxyethlene alkyl amide, polyoxypropylene alkyl amide, polyoxyethylene nonyl phenyl ether, polyoxyethylene lauryl phenyl ether, polyoxyethylene stearyl phenyl ester, and polyoxyethylene nonyl phenyl ester; and celluloses, such as methyl cellulose, hydroxyethyl cellulose, and hydroxypropyl cellulose may be utilized.

Further, when a compound that can be dissolved by both acid and alkali, such as calcium phosphate, is utilized as a dispersing agent, the calcium phosphate is removed from fine particles, for example, by dissolving the calcium phosphate by an acid, such as hydrochloric acid, and subsequently washing the fine particles with water. Alternatively, the dispersing agent can be removed by a process, such as a decomposition process using an enzyme.

When a dispersing agent is utilized, the dispersing agent may be left on the surfaces of the toner particles. However, it is preferable to remove the dispersing agent after the reaction by washing, from the viewpoint of the charging aspect of the toner. Further, in order to decrease viscosity of the toner components, a specific solvent can be utilized. Namely, the specific solvent is a solvent such that it can dissolve the polyester formed by causing the polyester prepolymer to be reacted and modified. It is preferable to use the solvent, since the particle size distribution becomes sharp. Further, it is preferable that the solvent be volatile and that the boiling point of the solvent be less than 100 degrees Celsius. The reason is that, when the boiling point of the solvent is less than 100 degrees Celsius, it is easy to remove the solvent. For example, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone may be individually utilized as the solvent. Alternatively, two or more of these can be combined and utilized as the solvent.

Especially, aromatic solvents, such as toluene, xylene, and halogenated hydrocarbons, such as methylene chloride, 1,2-dichloroethane, chloroform, and carbon tetrachloride are preferable. An amount of the solvent which is utilized with respect to 100 parts by mass of polyester prepolymer is usually in a range from 0 to 300 parts by mass. It is preferable that the amount be in a range from 0 to 100 parts by mass. Further, it is more preferable that the amount be in a range from 25 to 70 parts by mass. When the solvent is utilized, the solvent is removed by heating under a normal pressure or a reduced pressure, after the cross-linking reaction and/or the elongation reaction has been completed.

A reaction time of the cross-linking reaction and/or the elongation reaction is selected based on the reactivity defined by a combination of polyester prepolymer and a compound having the active hydrogen group. The reaction time is usually in a range from 10 minutes to 40 hours. It is preferable that the reaction time be in a range from 30 minutes to 24 hours. The reaction temperature is usually in a range from 0 to 100 degrees Celsius. It is preferable that the reaction temperature be in a range from 10 to 50 degrees Celsius. Further, known catalysts may be utilized, if necessary. Examples of such catalysts include tetiary amines such as triethylamine, and imidazole.

In order to remove the organic solvent from the obtained emulsified dispersion elements, the following specific method may be adopted. Namely, in the specific method, the whole system is gradually heated, and the organic solvent included in the liquid droplets is completely removed by evaporation. Alternatively, the toner fine particles may be formed by spraying the emulsified dispersion elements in a dry atmosphere, so as to completely remove the non-water soluble organic solvent. At this time, the aqueous dispersing agent can be removed by evaporation. As the dry atmosphere, to which the emulsified dispersion elements are sprayed, a gas which is prepared by heating, for example, the air, nitrogen gas, carbon dioxide gas, and combustion gas, may be utilized. Especially, various types of gases, each of which is heated to have a temperature higher than the boiling point of the solvent having the highest boiling point among those of the solvents included in the emulsified dispersion elements, are usually utilized. Sufficient quality is achieved through a short process by a spray dryer, a belt dryer, or a rotary kiln.

When the particle size distribution is broad during the emulsifying and dispersing process and the rinsing and drying process is performed without changing the particle size distribution, the particle size distribution may be adjusted by classifying the particle size distribution into desired particle size distributions. The particle size distribution can be classified by removing a fine particle portion in the solution, using, for example, a cyclone, a decanter, or a centrifugal separator. It is possible to classify the particle size distribution after the particles are dried and obtained as powders. However, because of the efficiency, it is preferable to classify the particle size distribution in the solution. The obtained unnecessary fine particles or coarse particles may be returned to the mixing and kneading process, so as to be used for forming particles. At that time, the fine particles or the coarse particles may be in a wet condition.

It is preferable to remove the used dispersing agent from the obtained dispersing liquid as much as possible. Further, it is preferable to remove the used dispersing agent at the time of performing the classification operation described above. Separation of heterogeneous particles, such as fine particles of the release agent, fine particles of the charge control agent, fine particles of a superplasticizer, and fine particles of the colorant, from surfaces of the obtained composite particles can be prevented by fixing or fusing the heterogeneous particles on the surfaces of the obtained dried toner particles by mixing the toner particles and the heterogeneous particles, or by applying mechanical impulsive forces to the mixed powders.

As a specific method, a method of applying impulsive forces to the mixture by a high-speed rotating blade, or a method of causing particles or composite particles to collide with a collision plate by throwing the mixture into a fast gas stream and accelerating the mixture can be considered. Examples of the devices include an angmill (produced by Hosokawa Micron Corporation), a device that is an I-type mill (produced by Nippon Pneumatic Mfg. Co., Ltd.) which is modified so as to decrease the grinding air pressure, HYBRIDIZATION SYSTEM (produced by Nara Machinary Co. Ltd.), CRYPTRON SYSTEM (produced by Kawasaki Heavy Industries, Ltd.), and an automatic mortar mixer.

[Outer Additive Agent]

The toner may include an outer additive agent that assists improving the flowability, the developability, and the charging ability of the toner. Inorganic fine particles are preferably utilized as an outer additive agent. It is preferable that the diameter of the inorganic fine particles be in a range from 5 nm to 2 μm, and it is especially preferable that the diameter be in a range from 5 nm to 500 μm. Further, it is preferable that the specific surface area of the inorganic fine particle according to the BET method be in a range from 20 to 500 $m^2/g$. Furthermore, it is preferable that the amount of the inorganic fine particles included in the toner be in a range from 0.01 to 5% by mass of the toner, and it is especially preferable that the amount be in a range from 0.01 to 2.0% by mass of the toner. Examples of the inorganic fine particles include silica, alumina, titanium oxide, barium titanate, magnesium titanate, calcium titanate, strontium titanate, zinc oxide, tin oxide, silica sand, clay, mica, tabular spar, diatom earth, chromium oxide, cerium oxide, red iron oxide, antimony trioxide, magnesium oxide, zirconium oxide, barium sulfate, barium carbonate, calcium carbonate, silicon carbide, and silicone nitride. Further, examples of the outer additive agent include polymer fine particles obtained by soap-free emulsion polymerization, suspension polymerization, or dispersion polymerization, such as polystyrene, and copolymers of mathacrylates or acrylates; particles of polycondensation polymers, such as silicone, benzoguanamine, and nylon; and polymer particles of a thermosetting resin.

Such a superplasticizer improves hydrophobicity of the toner by surface modification, and thereby preventing deterioration of the flowability and the charging ability of the toner under a high-humidity condition. Examples of the surface modification agent include silane coupling agents, silylation agents, silane coupling agents having a fluorinated alkyl group, organic titanate coupling agents, aluminum coupling agents, silicone oils, and modified silicone oils.

In order to remove the developer remaining on the photosensitive body or the primary transfer medium, an agent for improving the cleanability may be utilized. Examples of such an agent include metal salts of fatty acids, such as zinc stearate, calcium stearate, and stearic acid; and polymer fine particles produced by soap-free emulsion polymerization, such as fine particles of polymethyl methacrylate, and fine particles of polystyrene. It is preferable that the polymer fine particles have a sharp particle size distribution, and that the volume average particle diameter of the polymer fine particles be in a range from 0.01 to 1 μm.

As described above, according to the embodiments, it suffices to retrieve the information about the presence or absence of the halftone process and the information about the type of the gradation process to be utilized, in order to control the target fixing temperature. Therefore, a huge amount of information is not required, and it is possible to set an optimum target fixing temperature (for the fixing process) for each sheet of the recording media P during continuous printing, without selecting a particular mode. With this, an image forming device that satisfies the requirement on the reduction of the energy consumption and the requirement on the reduction of the start-up time can be provided. Further, as in the second and third embodiments, or as in the fifth and sixth embodiments, a finer temperature control that addresses various conditions can be realized, by combining the type of the dither method, the number of the lines, and other factors. Additionally, as explained in the examples shown in FIGS. 18-20, the target fixing temperature can be further lowered by switching at least one of the type of the dither method and the number of the lines, which have been set in advance, to the corresponding alternative which is more advantageous for the fixing property. In this manner, further energy reduction may be achieved.

Further, as explained by referring to FIG. 23, with a configuration in which the timing to start changing the target fixing temperature can be adjusted depending on the temperature difference between the target temperature prior to the change and the target temperature after the change, the fixing temperature can be adjusted to be a desired temperature for each sheet of the recording media P during continuous feeding, even if the number of the sheets of the recording media P fed per unit time is large. With this, a failure, such as the cold offset, which occurs when the fixing temperature is not raised in accordance with the target fixing temperature, can be prevented from occurring. Further, since it is not necessary to provide a time for waiting for the fixing temperature to be sufficiently raised, the fixing temperature can be switched, without lowering productivity (printing speed).

The present invention is not limited to the specifically disclosed embodiments, and variations and modifications may be made without departing from the scope of the present invention.

The present application is based on Japanese Priority Applications No. 2010-247493, filed on Nov. 4, 2010, No. 2010-253904, filed on Nov. 12, 2010, and No. 2011-128333, filed on Jun. 8, 2011 the entire contents of which are hereby incorporated herein by reference.

What is claimed is:

1. An image forming device comprising:

a fixing unit configured to fix a first image to be fixed onto a sheet, the first image to be fixed being supported on the sheet;

a target fixing temperature varying unit configured to vary a target fixing temperature during a time period in which a fixing process is performed; and a gradation processing unit configured to apply a gradation process to first image information, wherein the target fixing temperature varying unit is configured to vary the target fixing temperature for the sheet to which the fixing process is applied, depending on a presence or an absence of a halftone process, and depending on a type of the gradation process to be utilized, the gradation processing unit is configured to perform plural types of gradation processes, and the gradation processing unit is able to apply a dither method as a first one of the plural types of the gradation processes, and when the type of the gradation process to be utilized is the dither method, the target fixing temperature varying unit varies the target fixing temperature, depending on a type of the dither method, and depending on a first line density.

2. The image forming device according to claim 1, wherein the image forming device is configured to perform a copy output process for outputting second image information, the second image information being read from an original document, and configured to perform a printer output process for outputting third image information, the third image information being received from an external device, wherein, when the image forming device performs the copy output process, the gradation processing unit applies an error diffusion method, as a second one of the plural types of the gradation processes, and wherein, when the image forming device performs the printer output process, the gradation processing unit applies the dither method.

3. The image forming device according to claim 2, wherein, when the gradation processing unit applies the dither method as the first one of the plural types of the gradation processes, the target fixing temperature varying unit sets the target fixing temperature to a first temperature, wherein, when the gradation processing unit applies the error diffusion method as the second one of the plural types of the gradation process, the target fixing temperature varying unit sets the target fixing temperature to a second temperature, and wherein the first temperature is lower than the second temperature.

4. The image forming device according to claim 1, wherein operation modes of the image forming device include plural image forming modes for changing at least one of resolution of a fixed image and a level of a size of an image dot diameter, and wherein the gradation processing unit is configured to change the type of the dither method and the first line density, based on a specific image forming mode selected among the plural image forming modes.

5. The image forming device according to claim 4, wherein the image forming device includes an area detection unit configured to detect, for the sheet, text areas and photo areas in a second image, and wherein the gradation processing unit is configured to change the type of the dither method and the first line density, based on a detection result of the area detection unit.

6. The image forming device according to claim 1, wherein the gradation processing unit is configured to change at least one of a predefined type of the dither method and a predefined line density to corresponding at least one of a second type of the dither method and a second line density, wherein the predefined type of the dither method and the predefined line density are to be utilized for forming a predetermined image, and wherein the second type of the dither method and the second line density are more advantageous for fixing the predetermined image than the predefined type of the dither method and the predefined line density.

7. The image forming device according to claim 1, wherein the image forming device is configured to shift a timing to start varying the target fixing temperature from a first temperature for a first sheet to a second temperature for a second sheet, depending on a temperature difference between the first temperature and the second temperature, wherein the first sheet and the second sheet are included in plural sheets to which the fixing process is continuously applied, wherein the fixing process is applied to the second sheet, immediately after the fixing process has been applied to the first sheet.

8. The image forming device according to claim 7, wherein, when the second temperature is higher than the first temperature, the timing to start varying the target fixing temperature becomes earlier, as the temperature difference becomes greater.

9. The image forming device according to claim 7, wherein the timing to start varying the target fixing temperature is earlier for a first case in which the second temperature is higher than the first temperature, compared to the timing to start varying the target fixing temperature for a second case in which the second temperature is lower than the first temperature.

10. The image forming device according to claim 7, wherein the image forming device includes plural image forming units, and wherein, when the second temperature is higher than the first temperature, the timing to start varying the target fixing temperature is substantially equal to a timing at which an earliest image forming unit among the plural image forming units starts an image forming operation on the first sheet.

11. The image forming device according to claim 7, wherein, when the second temperature is lower than the first temperature, the timing to start varying the target fixing temperature is substantially equal to a timing at which the first sheet completes passing through the fixing unit.

12. The image forming device according to claim 1, wherein the fixing unit includes a fixing member configured to fix the first image to be fixed onto the sheet;

a pressing member configured to form a fixing nip by pressing the fixing member; and an induction heating unit configured to induction-heat the fixing member.

13. The image forming device according to claim 1, wherein the fixing unit includes a fixing belt having an endless shape and configured to fix the first image to be fixed onto the sheet;

a supporting member configured to support an inner circumferential surface of the fixing belt;

a heating member configured to heat the fixing belt;

a pressing member configured to press the fixing belt from an outer circumferential side; and a nip forming member disposed at an inner circumferential side and configured to form a fixing nip by contacting the pressing member through the fixing belt.

14. The image forming device according to claim 1, wherein the fixing device includes a fixing member configured to fix the first image to be fixed onto the sheet;

a pressing member configured to form a fixing nip by pressing the fixing member;

a heating member configured to heat at least one of the fixing member and the pressing member, wherein the heating member is formed by arranging a resistance heating unit inside a flexible film-like member.

15. The image forming device according to claim 1, wherein a temperature required for fixing a black toner is 10 degrees Celsius or more lower than a temperature required for fixing a color toner, wherein the black toner includes, at least, a thermoplastic resin, and wherein the thermoplastic resin includes, at least, a crystalline polyester resin, a non-crystalline polyester resin, a wax, and a colorant.

* * * * *